US005264657A

United States Patent [19]

Takauji

[11] Patent Number: 5,264,657

[45] Date of Patent: Nov. 23, 1993

[54] WAVEFORM SIGNAL GENERATOR

[75] Inventor: Kiyomi Takauji, Hamamatsu, Japan

[73] Assignee: Kawai Musical Inst. Mfg. Co., Ltd., Sizuoka, Japan

[21] Appl. No.: 511,097

[22] Filed: Apr. 19, 1990

[30] Foreign Application Priority Data

Apr. 24, 1989 [JP] Japan ..... 1-104126
Apr. 24, 1989 [JP] Japan ..... 1-104127

[51] Int. Cl.[5] ..... G10H 7/04

[52] U.S. Cl. ..... 84/607; 84/627; 84/663

[58] Field of Search ..... 84/604, 607, 622, 627-633, 84/605, 606, 663

[56] References Cited

U.S. PATENT DOCUMENTS

| | | | |
|---|---|---|---|
| 4,133,244 | 1/1979 | Hiyoshi et al. | 84/627 |
| 4,342,245 | 8/1982 | Gross | 84/604 |
| 4,461,199 | 7/1984 | Hiyoshi et al. | 84/604 |
| 4,539,884 | 9/1985 | Aoki | 84/604 |
| 4,683,793 | 8/1987 | Deutsch | 84/606 |
| 4,702,142 | 10/1987 | Deutsch | 84/605 |
| 4,738,179 | 4/1988 | Hideo | 84/604 |
| 4,785,702 | 11/1988 | Katoh | 84/604 |
| 4,922,797 | 5/1990 | Chapman | 84/650 |
| 4,930,390 | 6/1990 | Kellogg et al. | 84/611 |

*Primary Examiner*—William M. Shoop, Jr.
*Assistant Examiner*—Brian Sircus

[57] ABSTRACT

A parameter signal generator including a parameter generating information storing unit for storing parameter generating information necessary for generating a parameter signal, and a parameter signal generating unit for generating a parameter signal. The parameter generating information is serially read from the parameter generating information storing unit and the thus-read parameter generating information is preset in a parameter signal generating unit other than the parameter generating information storing unit. Therefore, the parameter signal generator includes a storing unit other than the parameter signal generating unit, and accordingly, a general-use memory can be employed as the storing unit, to substantially lower cost. The processing of generating and radiating musical sounds can be performed at a practically required speed by employing a high speed processor as a central processing unit. Further, in the parameter signal generator, the length of time necessary for repeatedly generating a part or all of the parameter signal is measured, and when the measured length of time becomes equal to a predetermined length of time, the processing of repeatedly generating a part or all of the parameter signal is stopped. Accordingly, the length of time needed for repeatedly generating the parameter signal can be kept at a constant value, regardless of the pitches of musical sounds to be radiated, and thus, the inclusion in a musical sound radiated by the electronic musical instrument of an unnecessary changing factor, in response to the change of the pitch thereof, can be prevented.

20 Claims, 22 Drawing Sheets (1)

(2)

WAVEFORM SIGNAL GENERATOR

BACKGROUND OF THE INVENTION

1. Field of the Invention

This invention generally relates to an electronic musical instrument and more particularly to a signal generator (hereunder sometimes referred to as a parameter signal generator) for generating signals (hereunder sometimes referred to as parameter signals) indicating parameters such as a musical tone waveform and an envelope waveform and so forth.

2. Description of the Background Art

In electronic musical instruments such as a MIDI (Musical Instrument Digital Interface) device (i.e. a digital musical device employing the MIDI specification), various information (hereunder sometimes referred to as parameter information) on parameters used for generating musical sounds is processed (for example, parameters representing a musical tone waveform, an envelope waveform, another waveform obtained by synthesizing a musical tone waveform, and an envelope waveform, the levels of which vary with time. In addition to such parameters, the parameter information includes information on data, the value of which varies with time, indicating a reading address of the parameter representing, for example, the musical tone waveform in a storage. Note, all kinds of waveforms such as a rectangular waveform, a triangular waveform, a sinusoidal waveform, and a waveform of a natural sound may be used as the musical tone waveform.

Hereinafter, as examples of conventional parameter signal generators, an envelope waveform generator for generating a parameter or data to be used for producing an envelope waveform, and a waveform data reading address generator for generating a parameter indicating a reading address of data indicating a musical tone waveform stored in a storage, will be described in detail with reference to FIGS. 15 and 16, respectively.

FIG. 16 shows a conventional envelope waveform generator provided in an electronic musical instrument, and this device corresponds to an envelope waveform generating device 29 of the present invention of FIG. 4 as described later. Further, the circuit of FIG. 4 corresponds to tone generators 15, 16, . . . of FIG. 3, as also described later.

In the circuit shown in FIG. 16, level data LVLi and speed data SPDi are read from a read-only memory (not shown) by a control unit (not shown), and all of the data read therefrom is written into an envelope forming data storing memory 239. Note, the level data LVLi and the speed data SPDi represent the value of an objective level and the value of an objective rate in each phase of an envelope, respectively.

Further, at the time of a KEY ON (namely, at the time of turning on a voice playing key (not shown) of the electronic musical instrument) or prior to the time of a KEY ON, data indicating the value of the amplitude or level of the envelope at the starting point thereof (hereunder referred to as the initial value of the amplitude of the envelope) is read from the read-only memory (ROM) by the control unit, and the initial value LVLO of the amplitude of the envelope is then set in an initial amplitude value holding memory 230. When the electronic musical instrument starts to radiate musical sounds, the initial value LVLO is supplied to an adder 234 through a selector 232.

The level data LVLi, however is read from an address of the memory 239, which is indicated by address data input thereto by a reading address generator 240, the two's complement of the data LVLi (namely, a negative value obtained by reversing the sign of the data LVLi) is then obtained by inverting each bit thereof by a complementer 233, and further, the thus-obtained two's complement is added to the initial amplitude value LVLO of the envelope by the adder 234. Accordingly, the value of the objective level indicated by the data LVLi is subtracted from the initial value LVLO of the amplitude of the envelope.

Envelope data ENV is also input to the selector 232, from an amplitude holding circuit 238, as described later, and after the radiation of the musical sounds is started, the envelope data ENV is input to the adder 234, whereupon the value of the objective level indicated by the data LVLi is subtracted from the value indicated by the envelope data ENV. Note, the envelope data ENV represents the current value of the level or amplitude of the envelope each time the data ENV is input to the adder 234.

Subsequently, subtraction data representing the result of the subtraction (the current value of the envelope data ENV—the value of the objective level indicated by the data LVLi) is multiplied by the speed data SPDi sent from the memory 239 by a multiplier 235. Note, before being input to the multiplier 235, the speed data SPDi is read from the address, indicated by the address data from the reading address generator 240; of the memory 239. Further, multiplication data representing the result of the multiplication, i.e., (the current value of the envelope data ENV−the value of the objective level indicated by the data LVLi)×(the value of the speed data SPDi), is added to the level data LVLi by an adder 236. Furthermore, data representing the result of this addition is stored in the amplitude holding circuit 238 and is output to a multiplier (not shown) as the envelope data ENV, whereby the envelope data ENV as shown in FIG. 6 is changed at a rate corresponding to the speed data SPDi. Also, the size of a step used for representing the change of the data ENV is changed in accordance with the value of the subtraction data (the current value of the envelope data ENV−the value of the objective level indicated by the data LVLi), and accordingly, as the value of the data ENV approaches that of the data LVLi, the size of the step used for representing the change of the data ENV is reduced.

Further, a KEY ON signal, the level of which becomes high while the playing key (hereunder sometimes referred to simply as the key) of a keyboard (not shown) is operated, is input to a KEY ON event detector 231, and a KEY ON event signal, the level of which becomes high at the time corresponding to the leading edge of the KEY ON signal and becomes low after the musical sounds are radiated, is then output from the detector 231. This KEY ON event signal is output to the selector 232, and upon receipt of the KEY ON event signal, the selector 232 selects the initial value LVLO and the output of the selector 232 is switched to a signal indicating the value LVLO. The KEY ON event signal is also output to and resets the reading address generator 240. Further, the above-described KEY ON signal is output to the reading address generator 240, which controls an address counting operation thereof in response to the KEY ON signal.

Moreover, the multiplication data (the current value of the envelope data ENV−the value of the objective level indicated by the data LVLi)×(the value of the speed data SPDi) is sent from the multiplier 235 to a comparator 237, whereupon it is determined whether or not the multiplication data is equal to 0. If this data is equal to 0, a coincidence signal is output from the comparator 237 as a phase terminating signal and input to the reading address generator 240, whereupon the reading address data is incremented by 1, and accordingly, the level data LVLi and the speed data SPDi for the next phase are read from the memory 239. The envelope generator then begins to generate the envelope data ENV to be used in the next phase.

FIG. 15 shows a conventional waveform data reading address generating device corresponding to the device 28 of the present invention, as shown in FIG. 4.

In the circuit of FIG. 15, loop top data LTi, loop end data LEi, and loop count data LCi are read from a ROM (not shown) by a control unit (not shown), and all of this data is then written into a memory 234 for storing control data used for regulating the reading address of waveform data. Note, as seen from FIG. 8, the loop top data LTi represents the leading address of a loop (hereunder sometimes referred to as a loop section) which is a part or section of the waveform to be repeatedly reproduced; the loop end data LEi represents the end address of the loop, and the loop count data LCi represents the number of times the reading of the waveform data corresponding to the loop is repeated.

Further, at a KEY ON or prior to the KEY ON, read operation starting address data ST is read from the ROM by the control unit, and this read operation starting address data ST is then set in a starting address holding memory 270. Similarly, at a KEY ON or prior to the KEY ON, phase angle step data PD is read from the ROM by the control unit, and this read phase angle step data PD is set in a phase angle step data memory 271.

As shown in FIG. 8, the data ST indicates the value of the reading address data RAD, i.e., the address, from which an operation of reading the musical tone waveform data WD is to be started, and the phase angle step data PD indicates the value of the increment (hereunder sometimes referred to as the incrementing step) used for incrementing the reading address data RAD. The address data RAD is updated by serially adding the phase angle step data PD thereto, and as the value indicated by the data PD becomes larger, the rate at which the data WD is read becomes larger and the pitch of the radiated musical sound becomes higher. Further, various timbres can be obtained by variously changing the read operation starting address data ST, the loop top data LTi, the loop end data LEi, and the loop count data LCi corresponding to the data WD.

When the radiation of musical sounds is started, the read operation starting address data ST set in the memory 270 is output through a selector 272 to an adder 273, whereupon the data PD from the memory 271 is added to the received data ST. Thereafter, addition data representing the result of this addition is output, through a selector 278, to and is stored in a waveform data reading address holding circuit 279. This addition data is also output to a waveform data storing memory (not shown) as the reading address data RAD, and after the radiation of musical sounds is started, the addition data is further output through the selector 272 to the adder 273, whereupon the data PD is again added to the addition data. Namely, the data PD is accumulated and added to the data RAD in an addition loop circuit composed of the adder 273 and the circuit 279.

Further, the two's complement of the data RAD from the adder 273 (i.e., a negative value obtained by reversing the sign of the data RAD) is obtained by inverting each bit thereof by a complementer 274, the thus obtained two's complement is added to the loop end data LEi from the memory 284 by the adder 275, and accordingly, the data RAD is subtracted from the data LEi.

This subtraction process is repeated so that part of the data WD corresponding to the loop section is read and further, the value indicated by the data RAD becomes equal to that indicated by the loop end data LEi. When this subtraction process is further effected, and the value indicated by the data RAD is higher than that indicated by the data LEi, a carry signal is output from an adder 275. This carry signal is fed to a difference holding circuit 276 as a latch signal, and thus fraction data indicating that the value indicated by the data RAD is higher than that indicated by the data LEi is latched by the circuit 276.

This fraction data is added to the loop top data LTi by an adder 277, whereby the fraction is compensated. Further, data indicating the result of this addition is output through the selector 278 to the waveform data reading address holding circuit 279 as updated data RAD, and thus the value indicated by the reading address data RAD to be used for reading the data WD jumps from that indicated by the loop end data LEi to that indicated by the loop top data LTi. At that time, the fraction corresponding to the difference of the value indicated by the data RAD to that indicated by the data LEi is also compensated. The carry signal from the adder 275 is supplied to the selector 278 as a loop end attainment signal, and as a result, the selector 278 selects the input from the adder 277. Further, the carry signal is input to a loop counter 281, whereupon the loop count indicating the number of times the data WD corresponding to the loop is actually read is incremented.

The value of the loop count obtained by the loop counter 281 is supplied to a comparator 283, whereupon it is determined whether or not the loop count is equal to the value indicated by the loop count data LCi. If the loop count is equal to the value indicated by the data LCi, a coincidence signal is output from the comparator 283 and input as a loop terminating signal to a reading address generator 285, whereupon the reading address data is incremented by 1 and the loop top data LTi, the loop end data LEi, and the loop count data LCi for the next loop are read from memory 284. The reading address generator then begins the reproduction of the next loop. Further, the coincidence signal from the comparator 283 is output to the loop counter 281 through a NOR gate 282 as a clearing signal.

Also, a KEY ON signal, the level of which becomes high while the key of the keyboard (not shown) is operated, is input to a KEY ON event detector 280, and a KEY ON event signal, the level of which becomes high at the time corresponding to the leading edge of the KEY ON signal and becomes low after the musical sounds are radiated, is then output from the detector 280. This KEY ON event signal is input to the loop counter 281 through the NOR gate 282 as the clearing signal, and further, is input to and resets the reading address generator 285.

Nevertheless, in the above-described conventional generators, as the number of phases of the envelope and of the loop sections increases, the quantity of the data to be stored in the memories 239 and 284 is increased. Further, to realize musical sounds which are closely allied to natural sounds and have complicated varying waveforms, a large amount of data must be set in the memories 239 and 284, which results in an increase of the memory capacity of the memories 239 and 284 in the conventional generators, and thus the conventional parameter signal generators have a defect in that they are expensive.

As a countermeasure, a system has been proposed in which the level data LVLi, the speed data SPDi, the loop top data LTi, the loop end data LEi, and the loop count data LCi are stored in a general-use memory, and this data is read by a central processing unit (CPU) from the general-use memory every time such data is needed, and further, the thus-read data is output by the CPU to the envelope waveform generator and the waveform data reading address generator. Accordingly, the cost of the envelope waveform generator and the waveform data reading address generator of this system becomes lower that of than the previously-described conventional generators. Also, a large-scale integration of the tone generators 15, 16, . . . including the envelope waveform generator and the waveform data reading address generator can be facilitated, and further, the cost of the storage for storing the data as above-described can be lowered because a general-use memory may be employed as such a storage.

Nevertheless, this conventional system using a general-use memory has a drawback in that the burden on the controller, such as the CPU, becomes large, and thus processing is delayed and it becomes very difficult to obtain a smooth radiation of musical sounds with this system, because the CPU must send data to the envelope waveform generator and the waveform data reading address generator every time such data is needed. Due to recent technological advances, however, high speed processors are now available, and therefore, even though the data required by the envelope waveform generator and the waveform data reading address generator is not stored in these generators but in another storage, musical sounds can be smoothly radiated by employing such a high speed processor as the CPU. The object of the present invention is to eliminate the defects of the above-described conventional parameter signal generators.

Further, in the above-described conventional generators, the number of repetitions of the reproduction of a loop is predetermined, i.e., the reproduction of a loop is limited by the required number of repetitions, and thus where the pitch of the musical sound to be radiated is low and the rate or speed of reading the data WD is small, the time needed to reproduce a loop becomes long. Namely, as shown in FIG. 17 (1), the ratio of the time taken to reproduce the loop to the time from the beginning of the radiation of a musical sound to the termination thereof becomes large. Conversely, where the pitch of the musical sound to be radiated is high, and thus the rate of reading the data WD is large, a time taken to reproduce a loop becomes short. Further, as shown in FIG. 17 (2), the ratio of the time taken to reproduce the loop to the time from the beginning of the radiation of a musical sound to the termination thereof becomes large.

The result of this is that the radiated musical sound includes an unnecessary changing factor or component, which is variable depending on the change in pitch of the musical sound to be radiated. Although a process of changing the proportion of higher harmonic components to the whole in response to the change in pitch is widely employed in the art, the higher harmonic components are not really necessary, and offend the ear when reproducing such a loop. Further, such an unnecessary factor causes a discrimination of the difference between the musical sound actually radiated by the electronic musical instrument and the corresponding musical sound issued by a conventional musical instrument such as a piano.

SUMMARY OF THE INVENTION

An object of the present invention is to provide a parameter signal generator which can process the radiation of musical sounds without delay and which is of substantially low cost.

Another object of the present invention is to provide a parameter signal generator by which the time required for reproducing a loop is maintained at a constant value regardless of the pitches of the musical sounds to be radiated.

To achieve the foregoing objects, and in accordance with a first aspect of the present invention, there is provided a parameter signal generator which includes a parameter generating information storing means for storing parameter generating information needed for generating a parameter signal, and a parameter signal generating means for generating a parameter signal, wherein the parameter generating information is serially read from the parameter generating information storing means and the thus-read parameter generating information is preset in a parameter signal generating means other than the parameter generating information storing means.

Namely, the parameter signal generator is provided with a parameter generating information storing means other than the parameter signal generating means, and thus a general-use memory can be employed as the parameter generating information storing means, whereby the cost of the parameter signal generator can be substantially lowered. In this case, the processing of generating and radiating musical sounds can be performed at a practically sufficient speed by employing a high speed processor as the CPU.

Further, in accordance with a second aspect of the present invention, there is provided a parameter signal generator wherein the length of time necessary for repeatedly generating a part or all of the parameter signal is measured, and when this measured length of time becomes equal to a predetermined length of time, the process of repeatedly generating a part or all of the parameter signal is stopped.

Accordingly, as shown in FIG. 9, the length of time needed for repeatedly generating the parameter signal can be maintained at a constant value regardless of the pitches of the musical sounds to be radiated, and thus the present invention can prevent the inclusion of an unnecessary changing factor in response to the change of the pitch in the musical sound radiated by the electronic musical instrument.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Other features, objects and advantages of the present invention will become apparent from the following description of preferred embodiments thereof with reference to the drawings, which are given by way of illustration only and thus are not limitative of the present invention and in which like reference characters designate like or corresponding parts throughout several views, wherein.

DESCRIPTION OF THE PREFERRED EMBODIMENTS

Hereinafter, preferred embodiments of the present invention will be described in detail, with reference to the accompanying drawings.

1. OUTLINE OF ENTIRE CONSTRUCTION OF THE EMBODIMENT

Figure 3:
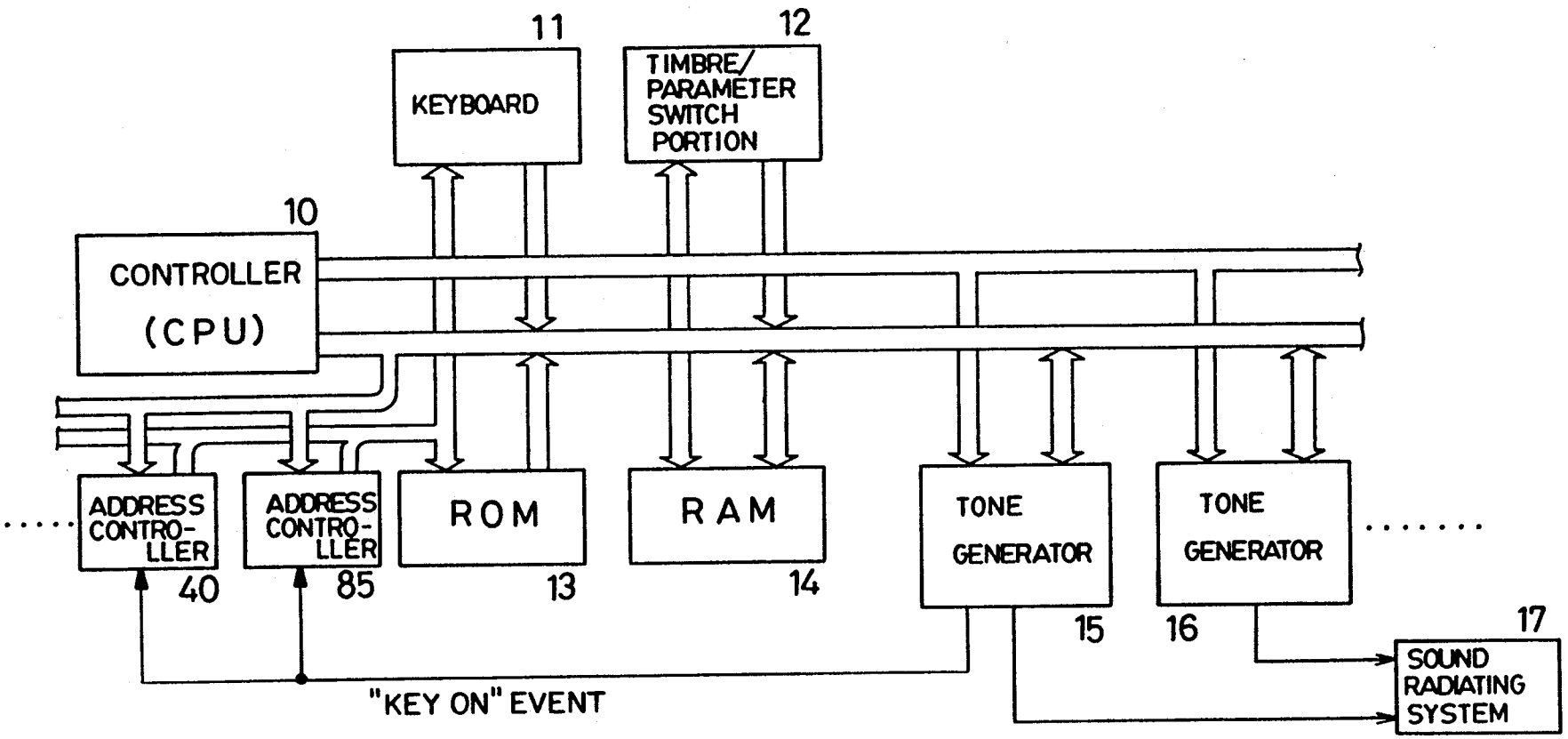
FIG. 3 is a circuit diagram showing the overall construction of the parameter signal generator embodying the present invention.

FIG. 3 shows the overall construction of the circuit of a parameter signal generator embodying the present invention. In this circuit, various processing programs to be executed by a controller 10, data to be used for repeatedly reading the musical tone waveform data WD (i.e., loop top data LTi, loop end data LEi, and loop time data LTMi) and data necessary for generating musical tone signals (for example, phase angle step data PD, read starting address data ST and initial amplitude value data LVLO, as described later) are stored in a read only memory (ROM) 13 and data for various intermediate processes to be performed in the controller 10, data to be used for detecting operating states of a keyboard 11 and of a timbre/parameter switching portion 12, and data assigned thereto in accordance with the operating states thereof, are stored in a random access memory (RAM) 14. Note, information on musical tones assigned to the tone generators 15, 16, . . . also may be stored in the RAM 14.

First, an operation of each key of the keyboard 11, and an operation of each switch of the timbre/parameter switching portion 12, is determined and detected by the controller 10 by a sampling process, and the electronic musical instrument then processes the generating and radiating of musical sounds having pitches indicated by the operated keys and corresponding to KEY TOUCH parameters (namely, parameters relating to the touching of a key) and timbres/parameters indicated by the operated switches. Musical sound signals representing the thus-indicated musical sounds are produced in the tone generators 15, 16, . . . , and further, the musical sound signals are mixed and thereafter output by a sound radiating system 17. Note, each of the tone generators 15, 16, . . . is constructed by a one-chip large-scale integrated (LSI) circuit.

Figure 12:
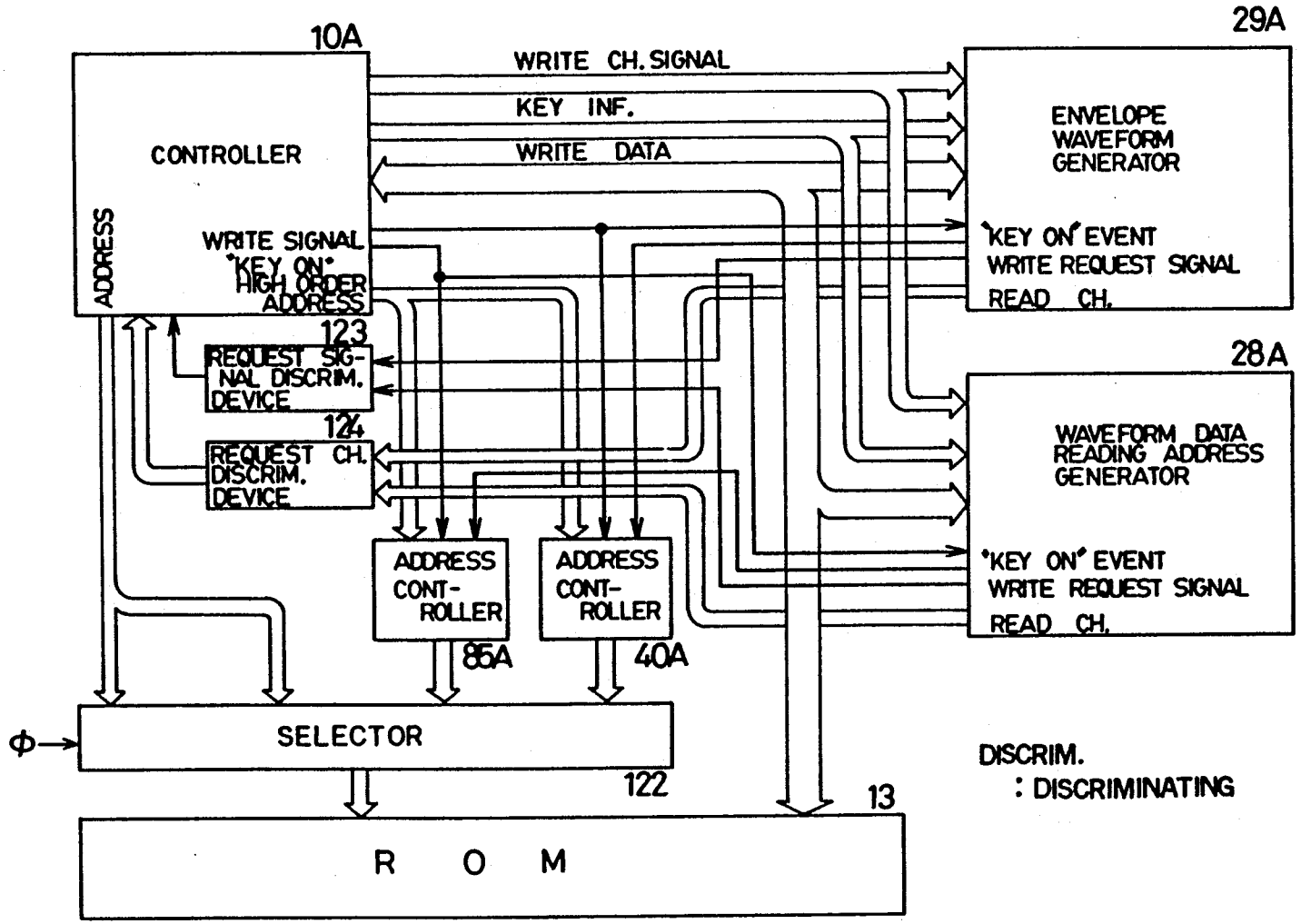

Further, the tone generators 15, 16, . . . perform the processes for reproducing the musical tone from the musical tone waveform data WD at every loop and generating each phase of the envelope. The tone generators 15, 16 . . . output write request signals at every end of the loop and the phase, the write request signal is once output to the controller 10, and thereafter, the write request signal is further output to address controllers 40, 85, . . . as write signals. Then the reading address data is incremented in such a manner that this data represents the addresses of the ROM 13 from which the next loop top data LTi, loop end data LEi, loop time data LTMi, speed data SPDi, and level data LVLi are to be read. This data is read from the ROM 13 and output to the tone generators 15, 16, . . . . Note, the plurality of address controllers 40, 85, . . . provided therein correspond respectively to the tone generators 15, 16, . . . , and in practice, the address controllers 40, 85, . . . have access to the ROM 13 in a time sharing manner, via a selector 122 as shown in FIG. 12. Further, the address data read from the address controllers is alternately replaced by address data sent from the controller 10.

2. TONE GENERATOR 15, 16 . . .

Figure 4:
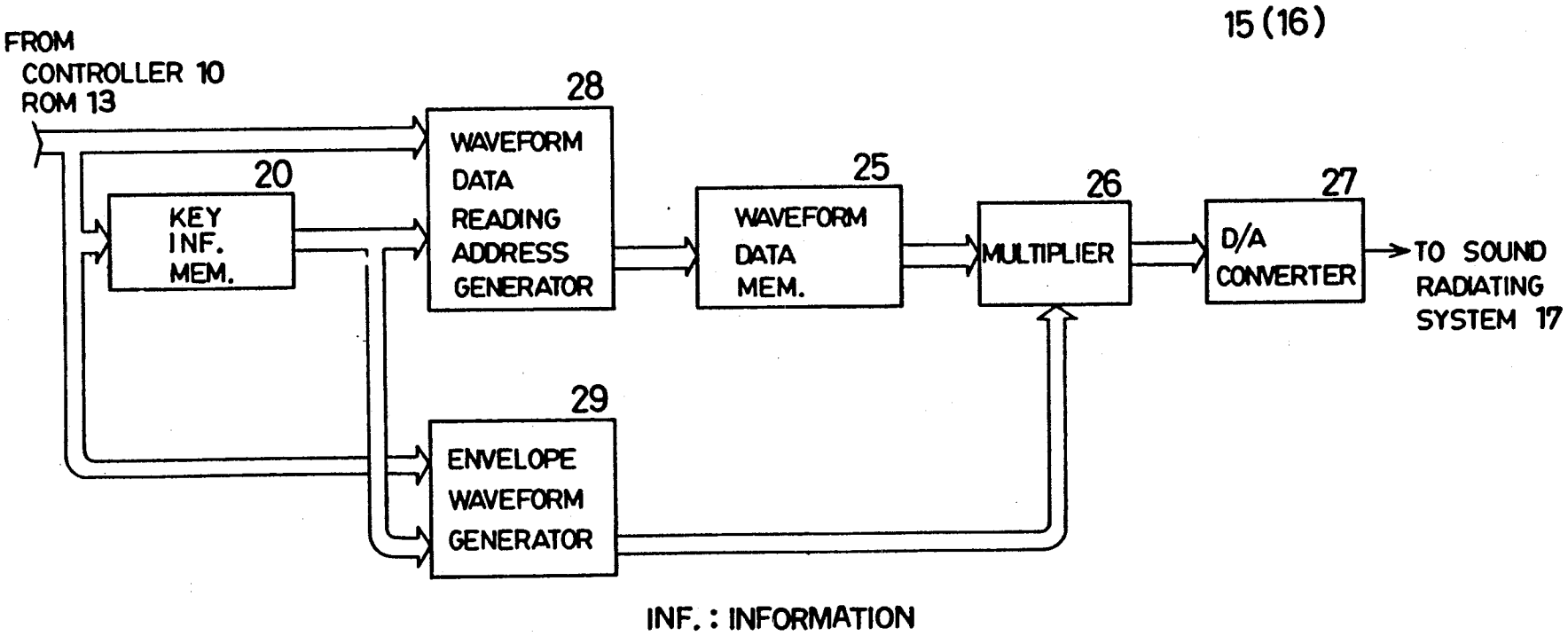
FIG. 4 is a circuit diagram of the tone generators 15, 16, . . .

FIG. 4 shows the construction of the tone generators 15, 16, . . . . The key information on keys, to which channels attached to the tone generators are assigned, simultaneously operated at the keyboard 11 is stored in a key information memory 20, and this key information is output to a waveform data reading address generator 28 and the envelope waveform generator 29, whereby musical sounds corresponding to the key information are generated by the electronic musical instrument. Also, the key information includes phase angle step data PD, read operation starting address data, ST, and initial amplitude value data LVLO, as described later. Note, instead of providing the key information memory 20 in the instrument, this data may be read directly from the ROM 13 by the controller 10. Alternately, this data may be output from the ROM 13 to the RAM 14, and thereafter, read from the RAM 14 by the controller 10.

The data read from the ROM 13, i.e., the loop top data LTi, the loop end data LEi, the loop time data LTMi, the speed data SPDi, and the level data LVLi is output to these generators 28 and 29, and thus reading address data RAD necessary for reproducing the loop, and the data ENV of each phase of the envelope, is generated. The reading address data RAD generated by the generator 28 is output to a waveform data memory 25, and the musical tone waveform data WD is then read from the reading address of the memory 25 as indicated by the data RAD. Further, the data WD thus read from the memory 25 is multiplied by the envelope data ENV from the generator 29, by the multiplier 26, and a digital signal representing the result of this multiplication is output from the multiplier 26 to a digital-to-analog (D/A) converter 27, which finally outputs the result as an analog signal.

3. ENVELOPE WAVEFORM GENERATOR 29

Figure 2A:
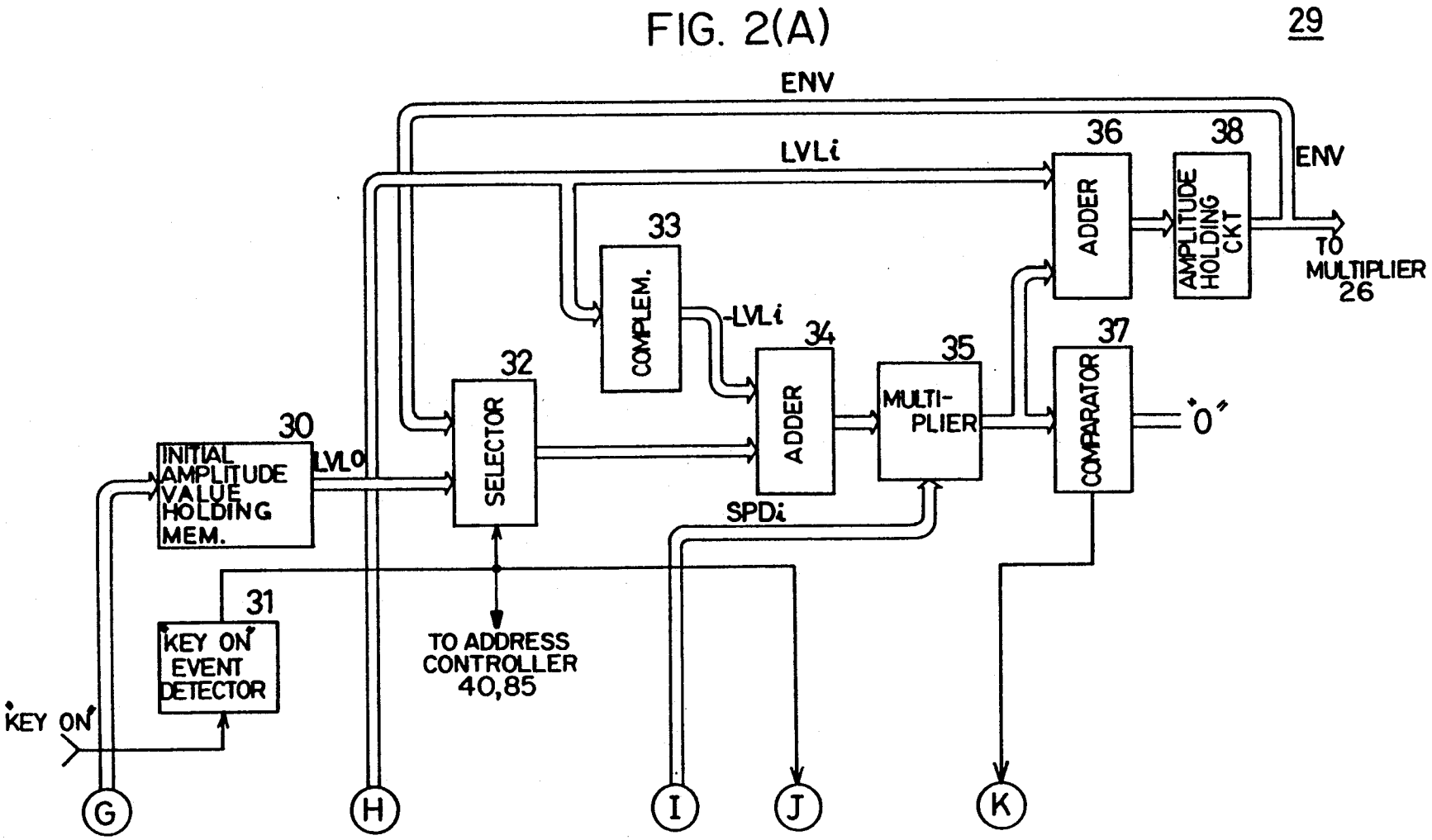
FIGS. 2(A) and 2(B) are circuit diagrams of the envelope waveform generator 29.
Figure 2B:
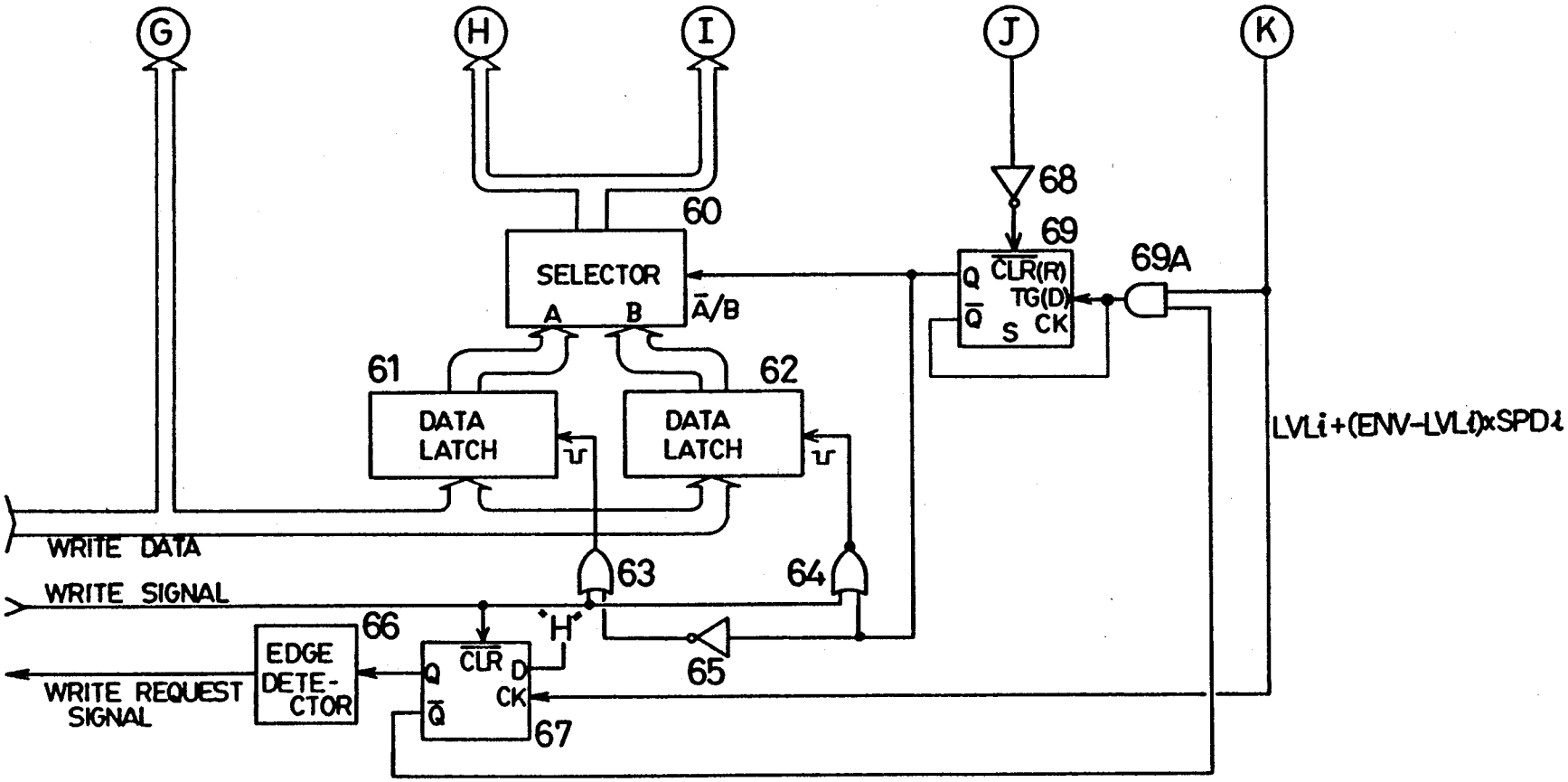

FIGS. 2(A) and 2(B) show the construction of the envelope waveform generator 29 of the present invention. The level data LVLi and the speed data SPDi of each phase of the envelope are read from the ROM 13 by the controller 10 and the address controller 40, and the thus-read data LVLi and SPDi are latched by one of data latches 61 and 62.

The remaining data latch, which has not latched the data LVLi and SPDi of a phase, has already latched the level data LVLi and the speed data SPDi relating to the envelope of another phase, currently being generated, and thus the data latch into which the data is written, and the other data latch from which the data is read, are alternately switched from one to the other. Regarding the level data LVLi and the speed data SPDi read from the data latch 61 or 62, the level data LVLi is output through a selector 60 to a complementer 33 and an adder 36, and on the other hand the speed data SPDi is output through the selector 35 to a multiplier 60.

Figure 6:
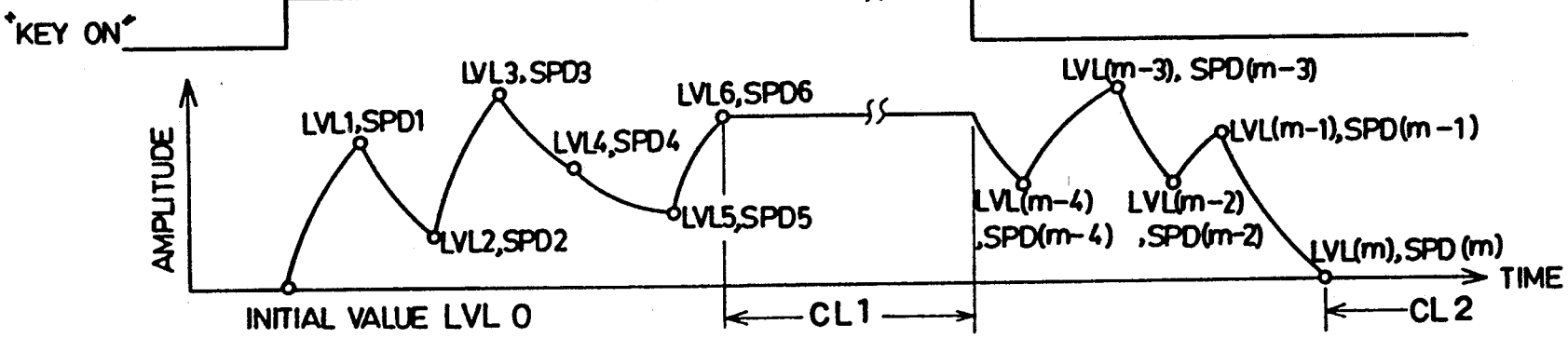
FIG. 6 is a diagram illustrating each phase of the envelope.

Further, as shown in FIG. 6, the level data LVLi and the speed data SPDi represent the value of an objective level and the value of an objective rate in each phase of an envelope, respectively.

Furthermore, at a KEY ON or prior to a KEY ON, data indicating the initial value LVLO of the amplitude of the envelope is read from the key information memory 20, and the initial value LVLO is then set in an initial amplitude value holding memory 30. In this case, the initial value LVLO may be read directly from the ROM 13 or the RAM 14 by the controller 10 and the address controller 40. When the electronic musical instrument starts radiating musical sounds, the data representing the initial value LVLO is supplied to an adder 34 through a selector 32.

The two's complement of the data LVLi (i.e., a negative value obtained by reversing the sign of the data LVLi) sent from the data latch 61 or 62 is obtained by inverting each bit thereof by a complementer 33, the thus-obtained two's complement is added to the initial amplitude value LVLO by the adder 34, and thus the value of the objective level indicated by the data LVLi is subtracted from the initial value LVLO. The complementer 33 may be comprised of, for example, a group of inverters, and in such a case, a signal having a high level is input to a terminal Cin of the adder 34, and thus the sign of the level data LVLi is reversed.

Envelope data ENV is also output to the selector 32 from an amplitude holding circuit 38, as described later. After the radiation of the musical sounds is started, the envelope data ENV is supplied to the adder 34, whereupon the value of the objective level indicated by the data LVLi is subtracted from the value indicated by the envelope data ENV. Note, the envelope data ENV represents the current value of the amplitude or level of the envelope at each output of the data ENV to the adder 34.

Subsequently, subtraction data representing the result of the subtraction (the current value of the envelope data ENV − the value of the objective level indicated by the data LVLi) is multiplied by the speed data SPDi sent from the data latch 61 or 62, by a multiplier 35. This multiplication data representing the result of the multiplication, i.e., (the current value of the envelope data ENV − the value of the objective level indicated by the data LVLi) × (the value of the speed data SPDi), is added to the level data LVLi by an adder 36, and data representing the result of this addition is stored in the circuit 38, and further, is output to a multiplier 26 as the envelope data ENV. Accordingly, the envelope data ENV as shown in FIG. 6 is changed at a rate corresponding to the speed data SPDi. Moreover, the size of a step to be used for representing the change of the data ENV is changed in accordance with the value of the subtraction data, i.e., (the current value of the envelope data ENV − the value of the objective level indicated by the data LVLi), and accordingly, as the value of the data ENV approaches that of the data LVLi, the size of the step used for representing the change of the data ENV is reduced.

Further, the multiplication data, i.e., (the current value of the envelope data ENV − the value of the objective level indicated by the data LVLi) × (the value of the speed data SPDi), is also output from the multiplier 35 to a comparator 37, whereupon it is determined whether or not the multiplication data is equal to 0. If this data is equal to 0, a coincidence signal is output from the comparator 37 as a phase terminating signal which is input to the CK-terminal of a D-type flip-flop 67. Further, a signal having a high level is always supplied to the D-terminal of the D-type flip-flop 67, and when the phase terminating signal is fed to the CK-terminal of the flip-flop 67, the level of the output Q thereof becomes high. This output Q having a high level is output to the address controller 40 through an edge detector 66 as write request signals for requesting the writing of the level data LVLi and the speed data SPDi for the next phase. Note, the edge detector 66 is used for detecting the leading edge of an input signal, and may be composed of, for example, a waveform shaping circuit using an operational amplifier.

In response to the write request signal, the speed data SPDi and the level data LVLi are latched by one of the data latches 61 and 62, as described above. In this case, the latch signal is a write signal having a low level and is output from the controller 10 in response to the write request signal. This latch signal is supplied to the data latch 61 or 62 through an OR gate 63 or 64, and the write request signal is input to the flip-flop 67 as a reset signal.

Further, the phase terminating signal from the comparator 37 is input to a flip-flop 69 through an AND gate 69A, whereby the output Q of the flip-flop 69 is inverted by inverter 65. Flip-flop 69 is a T-type flip-flop capable of performing a toggle operation and having an input TG connected to the output $\overline{Q}$ of D-type flip-flop 67 through AND gate 69A. When the reset signal is input thereto, the level of the output Q becomes low. The output Q of this flip-flop 69 is input to the selector 60 as a selection switching signal, and at the termination of each phase, the data selected by the selector 60 is switched between the data output from the data latches 61 and 62. The electronic musical instrument then begins to generate the envelope data ENV to be used in the next phase.

Further, the output Q of the flip-flop 69 is input to the OR gate 64 without being changed, and is also inverted by an inverter 65, the output of which is input to the OR gate 63. Therefore, the data latching operations by the data latches 61 and 62 are switched from one to the other. Moreover, the output $\overline{Q}$ of the flip-flop 67 is supplied to the AND gate 69A as an enable signal, and the AND gate 69A is kept in the enabled state until the writing of the next speed data SPDi and level data LVLi is performed.

Further, a KEY ON signal, the level of which becomes high while the key of the keyboard 11 is operated, is input to a KEY ON event detector 31, and then a KEY ON event signal, the level of which becomes high at the time corresponding to the leading edge of the KEY ON signal and becomes low after the musical sounds are radiated, is output from the detector 31. This detector 31 is used for detecting the leading edge of an input signal and comprises, for example, a waveform shaping circuit using an operational amplifier. Further, the KEY ON event signal is output to the selector 32, and at the time of starting the radiation of musical sounds, the selector 32 selects the initial value LVLO from the memory 30 and the output of the selector 32 is switched to a signal indicating the value LVLO. Furthermore, the KEY ON event signal is inverted by an inverter 68, and the inverted signal is subsequently output to and clears the flip-flop 69. Namely the data latch 61 is used at a KEY ON.

4. ADDRESS CONTROLLER 40

Figure 5:
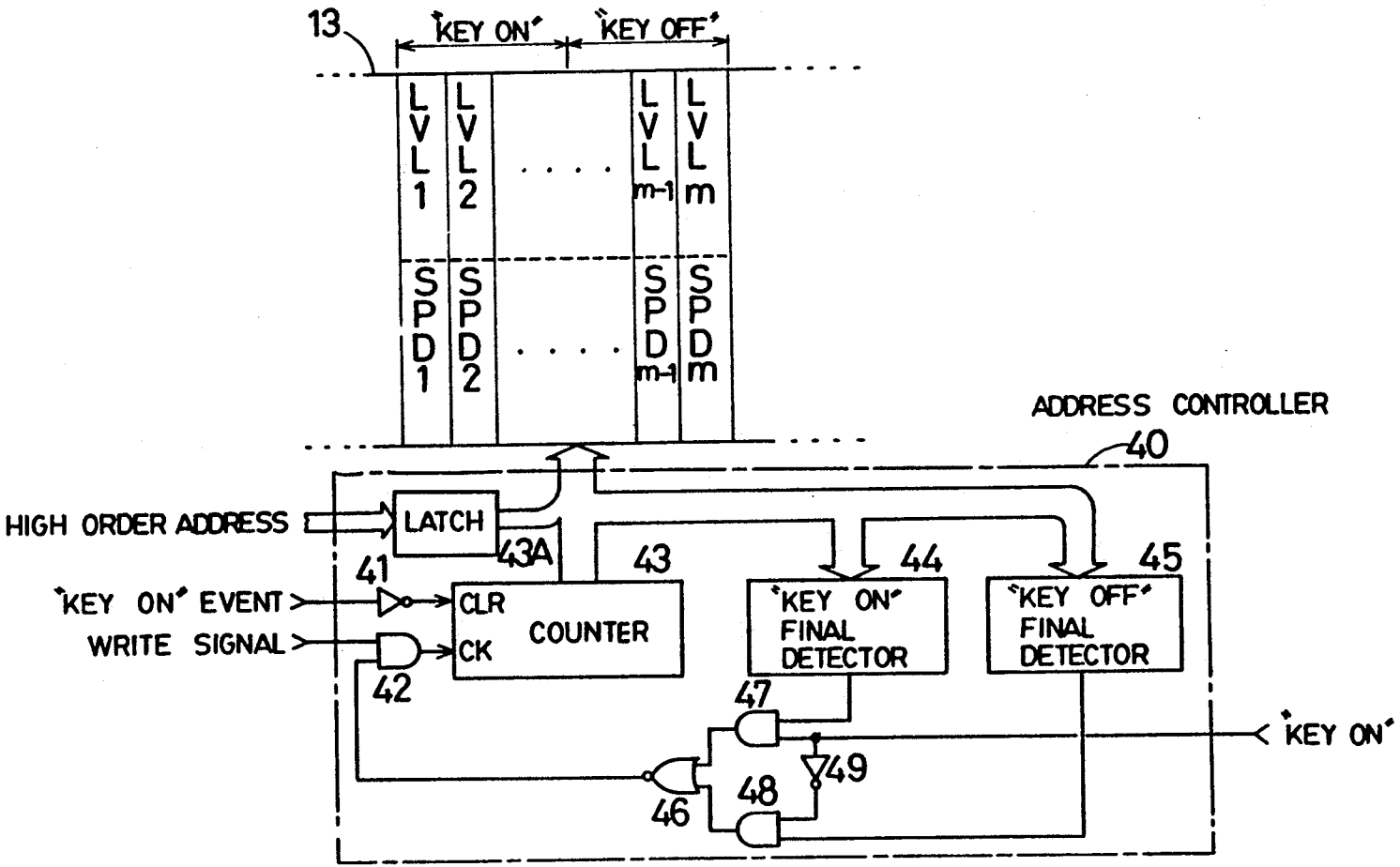
FIG. 5 is a circuit diagram showing an address controller 40 related to the envelope waveform and a ROM 13.

FIG. 5 is a circuit diagram showing the address controller 40 and a part of the ROM 13 from which data is read by the address controller 40. A counter 43 is cleared by an input of the KEY ON event signal from the tone generator 15, 16, . . . In practice, a signal inverted by an inverter 41 is used as the KEY ON event signal.

Further, in response to the write signal output from the controller 10, the contents of a counter 43 are incremented by 1, and thus the addressing of the level data LVLi and the speed data SPDi stored in the ROM 13 is serially changed. Furthermore, high order address data representing the storage areas of the ROM 13 in which the level data LVLi and the speed data SPDi are stored, is added to the data representing the contents of the counter 43, and then a signal indicating the results of the addition is output from the address controller 40 to the ROM 13. In this case, the high order address data is preset in a latch 43A by the controller 10. Note, the storage areas may be selected or indicated in accordance with the timbres, pitches or compass of the musical sounds, and alternatively, data obtained by preliminarily inverting a specific one of low level (ground level) bits of the output of the counter 43 may be used as the high order address data.

Further, an AND gate 42 is disabled for a part CL1 of the period for which the electronic musical instrument is in the KEY ON state as shown in FIG. 6, and for a part CL2 of the period for which the musical instrument is in the KEY OFF state, as shown in this Figure. Note, as shown in FIG. 6, a constant level of the envelope is maintained in the period CL1, and similarly, the level of the envelope is kept equal to 0 in the period CL2. Namely, when the level data LVL6 and the speed data SPD6 are read immediately prior to the beginning of the period CL1, a KEY ON final detector 44 detects this state from the data output by the counter 43 and outputs a detection signal through an AND gate 47 to a NOR gate 46, whereupon the detection signal is inverted. Subsequently, the inverted signal is output to the AND gate 42, whereby the gate 42 is disabled and the incrementing of the contents of the counter 43 is temporarily stopped.

When the level data LVLm and the speed data SPDm are read immediately prior to the beginning of the period CL2, however a KEY OFF final detector 45 detects this state from the data output by the counter 43 and outputs a detection signal through an AND gate 48 to the NOR gate 46, whereupon the detection signal is inverted. Subsequently, the inverted signal is supplied to the AND gate 42, whereby the gate 42 is disabled and the incrementing of the contents of the counter 43 is temporarily stopped. At that time, the level of the KEY ON signal is low. Further, the KEY ON signal is output through an inverter 49 to an AND gate 48, which is thus enabled.

Accordingly, the level data LVLi and the speed data SPDi can be stored in the ROM 13 instead of the tone generators 15, 16, . . . , and further, a general-use storage may be used as the ROM 13. Therefore, in accordance with the present invention, the cost of the envelope waveform generator 29 can be lowered. Moreover, a large-scale integration of the tone generators 15, 16, . . . each including the envelope waveform generator 29 is facilitated.

5. WAVEFORM DATA READING ADDRESS GENERATOR 28

Figure 1A:
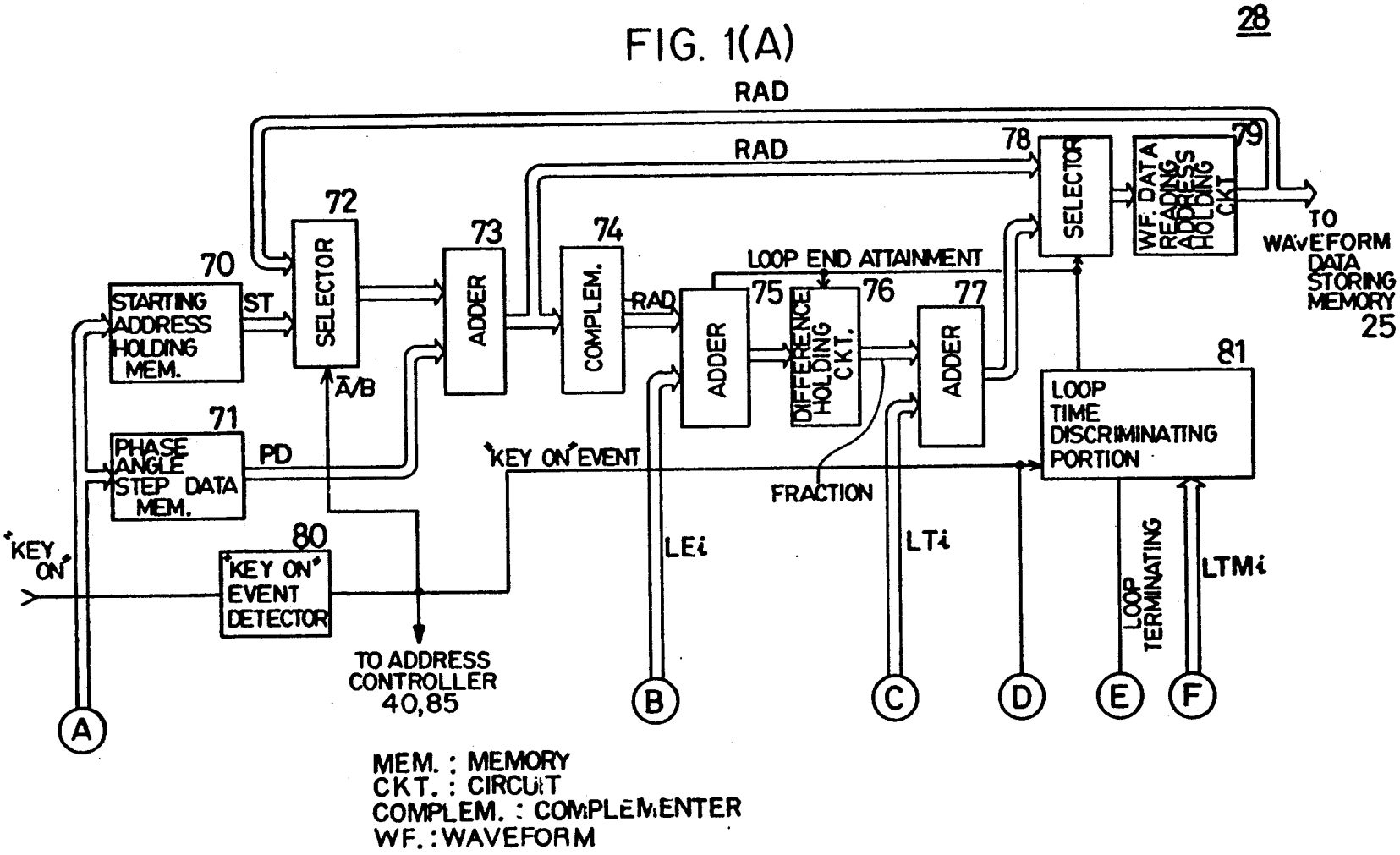
FIGS. 1(A) and 1(B) are circuit diagrams of the waveform data reading address generator 28.
Figure 1B:
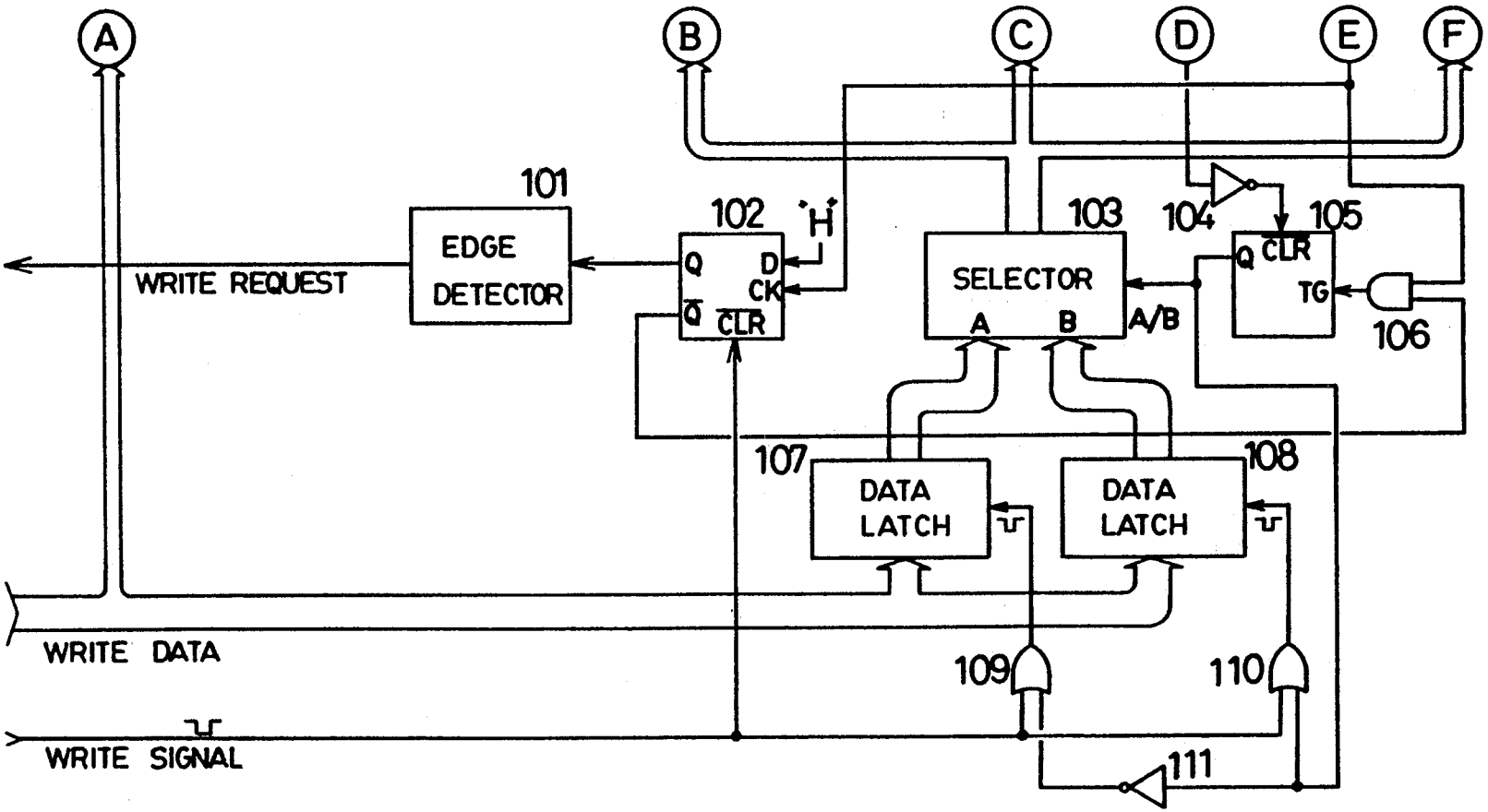

FIGS. 1(A) and 1(B) show the construction of the waveform data reading address generator 28 of the present invention. The loop top data LTi, the loop end data LEi, the loop time data LTMi, which are used for reproducing the part of the musical tone waveform data WD corresponding to the loop, are read from the ROM 13 by the controller 10 and an address controller 85 and are then latched by one of data latches 107 and 108. The data latch which has not latched the data LTi, LEi, and LTMi of a generated phase has already latched the level data LTi, LEi, and LTMi relating to the envelope of another phase, which is currently being generated, and thus the data latch to which the data is written, and the other data latch from which the data is read, are alternatively switched one with the other. Regarding the level data LTi, LEi, and LTMi read from the data latch 107 or 108, the loop top data LTi is output through a selector 103 to an adder 77, and the loop end data LEi is output through the selector 103 to an adder 75. Further, the loop time data LTMi is output through the selector 103 to a loop time discriminating portion 81.

Note, as described above, the loop top data LTi represents the leading address of the loop; the loop time data LTMi represents the part of the tone waveform data WED of the loop which is repeatedly reproduced; and the loop end data LEi represents the end address of the loop; and the loop count data LCi represents the number of repetitions of reading the waveform data corresponding to the loop.

Further, at a KEY ON or prior to a KEY ON, the read operation starting address data ST is read from the key information memory 20, and this read operation starting address data ST is then set in a starting address holding memory 70. Similarly, at a KEY ON or prior to a KEY ON, the phase angle step data PD is read from the memory 20, and this read phase angle step data PD is then set in a phase angle step data memory 71. In this case, the data read operation starting address ST and the phase angle step PD may be read directly from the ROM 13 or the RAM 14 by the controller 10 and the address controller 40.

Figure 8:
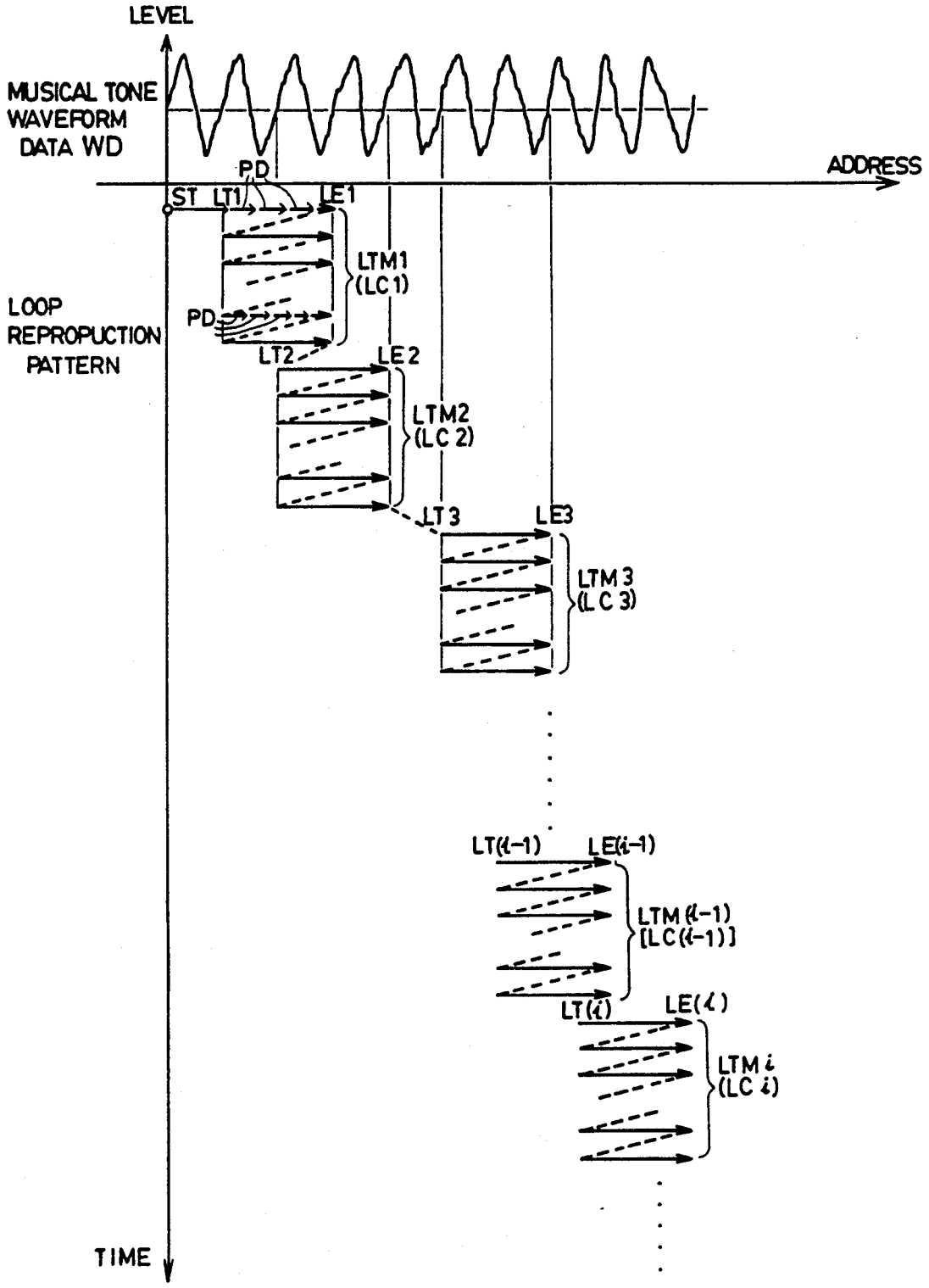
FIG. 8 is a diagram illustrating the musical tone waveform data WD and each loop section of the data WD.

As shown in FIG. 8, the data ST indicates the value of the reading address data RAD, i.e., the address, from which an operation of reading the musical tone waveform data WD is to be started, and the phase angle step data PD indicates the value of the increment step used for incrementing the reading address data RAD. The address data RAD is updated by serially adding the phase angle step data PD thereto, and as the value indicated by the data PD becomes larger, the rate at which the data WD is read becomes larger and the pitch of the radiated musical sound becomes higher. Further, various timbres can be obtained by variously changing the read operation starting address data ST, the loop top data LTi, the loop end data LEi, and the loop count data LTMi corresponding to the data WD.

When the radiation of musical sounds is started, the read operation starting address data ST set in the memory 70 is output through a selector 72 to an adder 73, whereupon the data PD from the memory 71 is added to the received data ST. Then addition data representing the results of this addition is output, through a selector 78, to and is stored in a waveform data reading address holding circuit 79. This addition data is also output to the waveform data storing memory 25 as the reading address data RAD. After the radiation of musical sounds is started, the addition data is further output through the selector 72 to the adder 73, whereupon the data PD is again added to the addition data. Namely, the data PD is accumulated and added to the data RAD in an addition loop circuit, composed of the adder 73 and the circuit 79.

Further, the two's complement of the data RAD from the adder 73 (i.e., a negative value obtained by reversing the sign of the data RAD) is obtained by inverting each bit thereof by a complementer 74, and the thus-obtained two's complement is added to the loop end data LEi output from the data latch 107 or 108, by the adder 75, and accordingly, the data RAD is subtracted from the data LEi. The complementer 74 may comprise, for example, a group of inverters, and in this case, a signal having a high level is input to a terminal Cin of the adder 75, and thus the sign of the reading address data RAD is reversed.

This subtraction process is repeated so that the part of the data WD corresponding to the loop section is read, and further, the value indicated by the data RAD becomes equal to that indicated by the loop end data LEi. When this subtraction process is further effected and the value indicated by the data RAD is higher than that indicated by the data LEi, a carry signal is output from the adder 75. This carry signal is input to a difference holding circuit 76 as a latch signal, and thus fraction data indicating that the value indicated by the data RAD is higher than the value indicated by the data LEi is latched by the circuit 76.

This fraction data is added to the loop top data LTi by an adder 77, whereby the fraction is compensated, and further, data indicating the result of this addition is output through the selector 78 as updated data RAD, to the circuit 79, whereby the value indicated by the reading address data RAD to be used for reading the data WD jumps from that indicated by the loop end data LEi to that indicated by the loop top data LTi. At that time, a compensation of the fraction corresponding to the difference of the value indicated by the data RAD to that indicated by the data LEi is effected. The carry signal from the adder 75 is output to the selector 78 as a loop end attainment signal, and as a result, the selector 78 selects the input from the adder 77, and further, the carry signal is fed to a loop time discriminating portion counter 81.

6. LOOP TIME DISCRIMINATING PORTION 81

Figure 10:
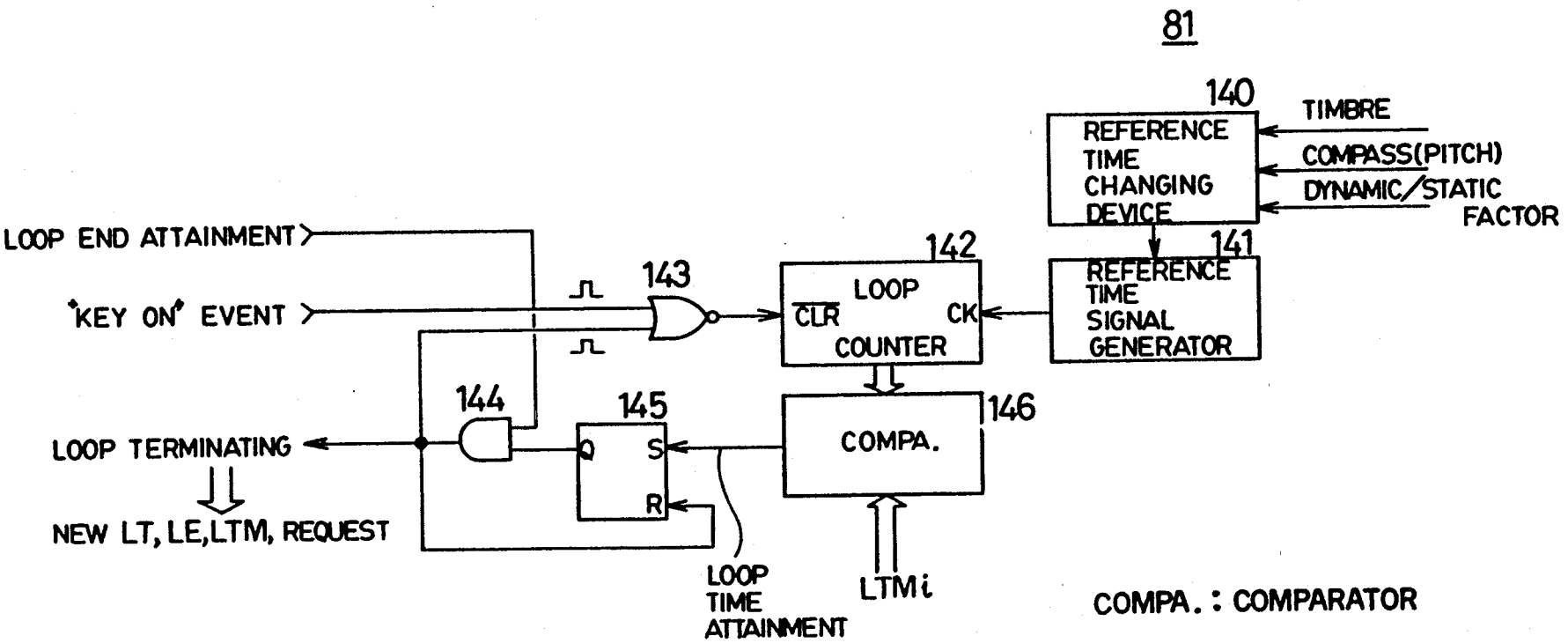
FIG. 10 is a circuit diagram of a loop time discriminating portion 81.

FIG. 10 shows the construction of the loop time discriminating portion 81. Figure Loop time discriminating portion 81 includes a reference time changing device 140, which may be constructed by using a decoder, decodes timbre data, compass data and other various parameter data (representing dynamic or static factors), which are output from the key information memory 20 or from the ROM 13 or the RAM 14, as indicated by the controller 10. The decoded data is then fed to a reference time signal generator 141, and the timbre data and the parameter data are selected and indicated by the timbre/parameter switching portion 12. Further, the compass data is based on the key codes input from the keyboard 11; for example, octave data of the key code may be used as the compass data. Moreover, the parameter data indicates selected effects and rhythms and the contents of the indication output by controllers such as a modulation wheel and a pitch bender.

The reference time signal generator 141 may be constructed by, for example, a programmable binary counter and a programmable dividing counter, and outputs a pulse signal having a period corresponding to the decoded data from the reference time changing device 140, to a loop counter 142, and accordingly, the loop time data LTM relating to the loop section (i.e., a part of the musical tone waveform data WD which is repeatedly reproduced) can be changed in accordance with the timbre, the compass, and the parameter data.

The loop counter 142 counts pulse signals input thereto and outputs time count data indicating the count to a comparator 146, whereupon the loop time data LTMi output from the data latch 107 or 108 is compared with the time count data from the loop counter 142. If a coincidence there between occurs, the comparator 146 outputs a coincidence signal to the S-terminal of an SR-type flip-flop 145, as a loop time attainment signal by which the flip-flop 145 is reset. Further, an AND gate 144 is enabled upon receiving the output Q of the flip-flop 145.

Immediately after this, the loop end attainment signal is output as a loop terminating signal from the enabled AND gate 144 to the R-terminal of the flip-flop 145, which is then reset. Further, the loop terminating signal is input to the loop counter 142 through a NOR gate 143 as a clearing signal. The KEY ON event signal, the level of which becomes high at the time of starting the radiation of a musical sound, is also input to the loop counter 142 through the NOR gate 143 as a clearing signal.

Further, as shown in FIG. 1(A) and 1(B), the loop terminating signal is input to the CK-terminal of a D-type flip-flop 102 having a D-terminal which always receives a signal having a high level. Therefore, when the loop terminating signal is input to the CK-terminal of the flip-flop 102, the level of the output Q thereof becomes high. This output Q thereof is output through an edge detector 101 to the controller 10 and the address controller 85 as a write request signal for requesting the writing of the next loop top data LTi, loop end data LEi, and loop time data LTMi. The edge detector 101 is used for detecting the leading edge of the input signal and may be constructed by a waveform shaping circuit using an operational amplifier.

In response to the write request signal, the loop top data LTi, the loop end data LEi, and the loop time data LTMi are latched by one of the data latches 107 or 108, as described above. In this case, the latch signal is a write signal having a low level and output in response to the write request signal input from the controller 10. This latch signal is sent to the data latch 107 or 108 through an OR gate 109 or an OR gate 110, and the write signal is input to the flip-flop 102 as a reset signal.

Further, the loop terminating signal from the circuit 81 is input to a flip-flop 105 through an AND gate 106, whereby the output Q of the flip-flop 105 is inverted. This is a T-type flip-flop 105 capable of performing a toggle operation, and having an input D connected to the output $\overline{Q}$ of a D-type flip-flop 102 and gate 106. When the reset signal is input thereto, the level of the output Q becomes low and is output to the selector 103 as a selection switching signal. At the termination of each loop section, the data selected by the selector 103 is switched between the data output from the data latches 107 and 108, and then the electronic musical instrument begins to generate the reading address data to be used for reproducing the next loop section.

Further, the output Q of the flip-flop 105 is input to the OR gate 110 without change, and is also inverted by an inverter 111, the output of which is input to the OR gate 109. Accordingly, the data latching operations, by the data latches 107 and 108 are switched from one to the other. Moreover, the output $\overline{Q}$ of the flip-flop 102 is input to the AND gate 106 as an enable signal, and the AND gate 109 is kept in the enabled state until the writing of the next loop top data LTi, the loop data LEi, and the loop time data LTMi is performed.

Further, a KEY ON signal, the level of which becomes high while a key of the keyboard 11 is operated, is input to a KEY ON event detector 80, and then a KEY ON event signal, the level of which becomes high at the time corresponding to the leading edge of the KEY ON signal and becomes low after the musical sounds are radiated, is output from the detector 80. The detector 80 is used for detecting the leading edge of an input signal and comprises, for example, a waveform shaping circuit using an operational amplifier. Further, the KEY ON event signal is output to the selector 72, and at the time of starting the radiation of musical sounds, the selector 72 selects the read operation starting address data ST from a starting address holding memory 70 and the output of the selector 72 is switched to a signal indicating the data ST. Furthermore, the KEY ON event signal is inverted by an inverter 104, and the inverted signal is subsequently input to and clears the flip-flop 105. Accordingly the data latch 107 is used at a KEY ON.

7. ADDRESS CONTROLLER 85

Figure 7:
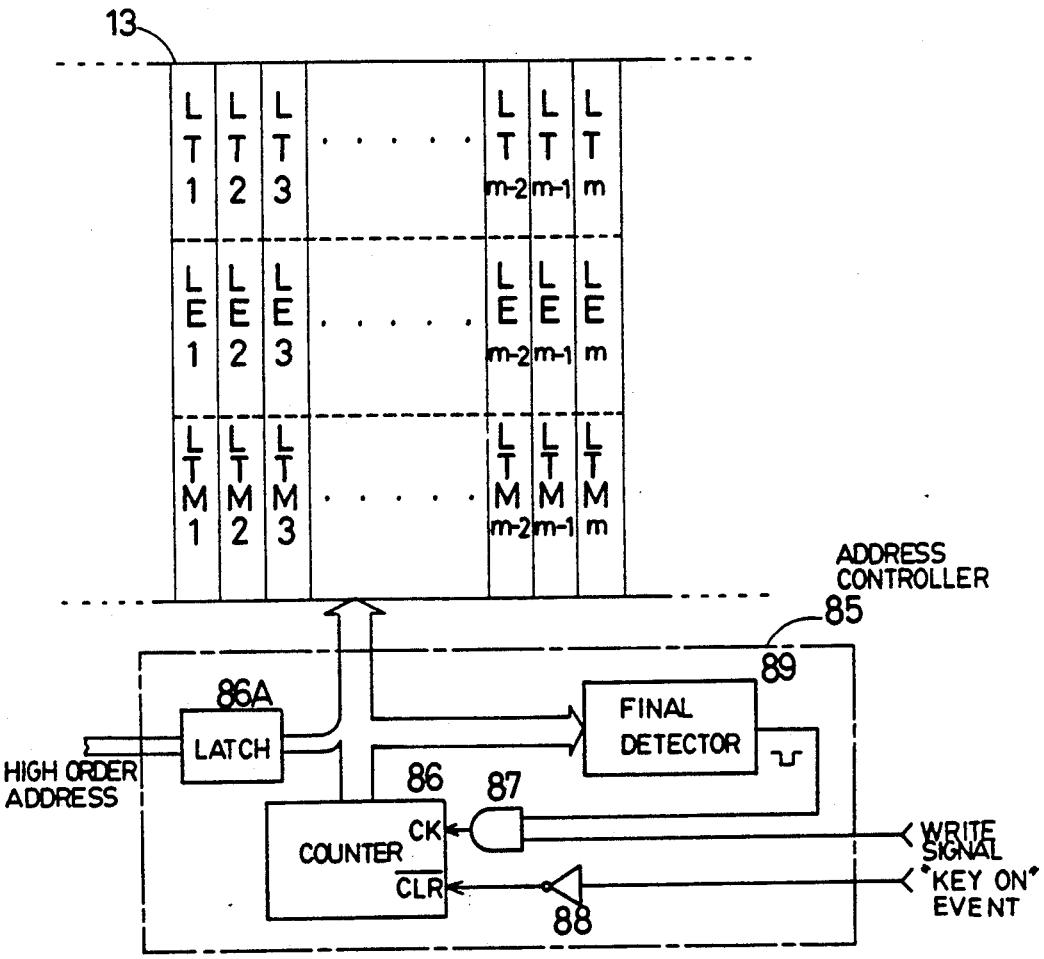
FIG. 7 is a circuit diagram showing an address controller 85 relating to the musical tone waveform and the ROM 13.

FIG. 7 is a circuit diagram showing the address controller 85 and a part of the ROM 13 from which the data is read by the address controller 85. A counter 86 is cleared upon an input of the KEY ON event signal from the tone generator 15, 16, . . . In practice, a signal inverted by an inverter 88 is practically used as the KEY ON event signal.

Further, in response to the write signal output by the controller 10, the contents of a counter 86 are incremented by 1, and thus the addressing of the loop top data LTi, the loop end LEi, and the loop data LTMi stored in the ROM 13 is serially changed. Further, high order address data representing the storage areas of the ROM 13 in which the loop top data LTi, the loop end LEi and the loop data LTMi are stored, is added to the data representing the contents of the counter 86, and a signal indicating the result of the addition is then output from this address controller 85 to the ROM 13. In this case, the high order address data is preset in a latch 86A by the controller 10. Note instead of this, the storage areas may be selected or indicated in accordance with the timbres, pitches or compass of the musical sounds, and alternatively, data obtained by preliminarily inverting a specific one of low level (ground level) bits of the output of the counter 86 may be used as the high order address data.

Then the reading address data from the counter 86 is output to a final detector 89, and when the reading address data becomes equal to the terminal address of the storage areas in which the loop top data LTi, the loop end LEi, and the loop data LTMi are stored, the level of the output of the final detector 89 becomes low, and thus the AND gate 87 is disabled. Accordingly, after the loop top data LTi, the loop end data LEi, and the loop time data LTMi corresponding to the last section are read from the ROM 13, the repeated reading of the part of the data WD corresponding to the last loop section is continued.

Figure 9:
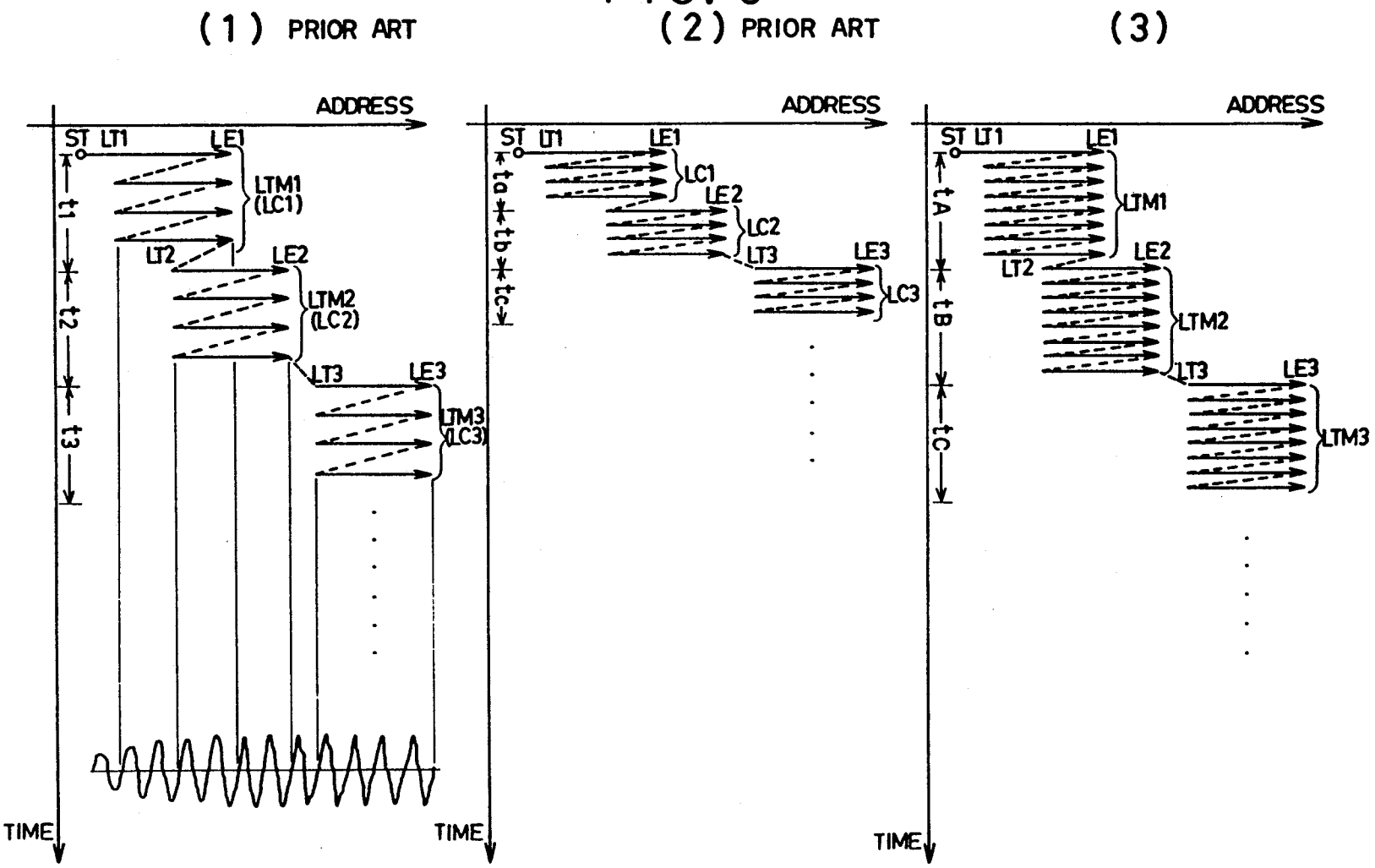
FIGS. 9(1), 9(2) and 9(3) are diagrams illustrating the change of the reproduction of a loop in response to that of the pitch of the musical sound to be radiated.

Accordingly, the loop top data LTi, the loop end data LEi, and the loop time data LTMi can be stored in the ROM 13 instead of the tone generators 15, 16, . . . Further, a general-use storage may be used as the ROM 13, and therefore, in accordance with the present invention, the cost of the waveform data reading address generator 28 can be lowered. Moreover, a large-scale integration of the tone generators 15, 16, . . . , each including the waveform data reading address generator 28, can be facilitated.

Where the musical tone waveform data WD stored in the waveform data storing memory 25 is repeatedly read by the above-described waveform data reading address generator 28, a comparator 146 of FIG. 10 does not compare a predetermined value with the number of repetitions of the reproduction of the loop but compares it with the time taken to reproduce the loop. Therefore, where the pitch is low and the rate of reading the data WD is small as shown in FIG. 9 (1), or where the pitch is high and the rate of reading the data WD is large, as shown in FIG. 9 (3), the time taken to reproduce a loop is a constant value. Accordingly, a high pitch and a large rate of reading the data WD, as shown in FIG. 9 (2), can be prevented, and thus the time taken to reproduce a loop is shortened.

Namely, the time taken to reproduce each loop becomes a constant value regardless of the pitch. Further, loop sections during the radiation of a musical sound can be well-balanced, and thus, an inclusion in the musical sound radiated by the electronic musical instrument of an unnecessary changing factor, in response to the change of the pitch thereof, can be prevented.

8. AN EMBODIMENT FOR GENERATING POLYPHONIC MUSICAL SOUNDS

Figure 11:
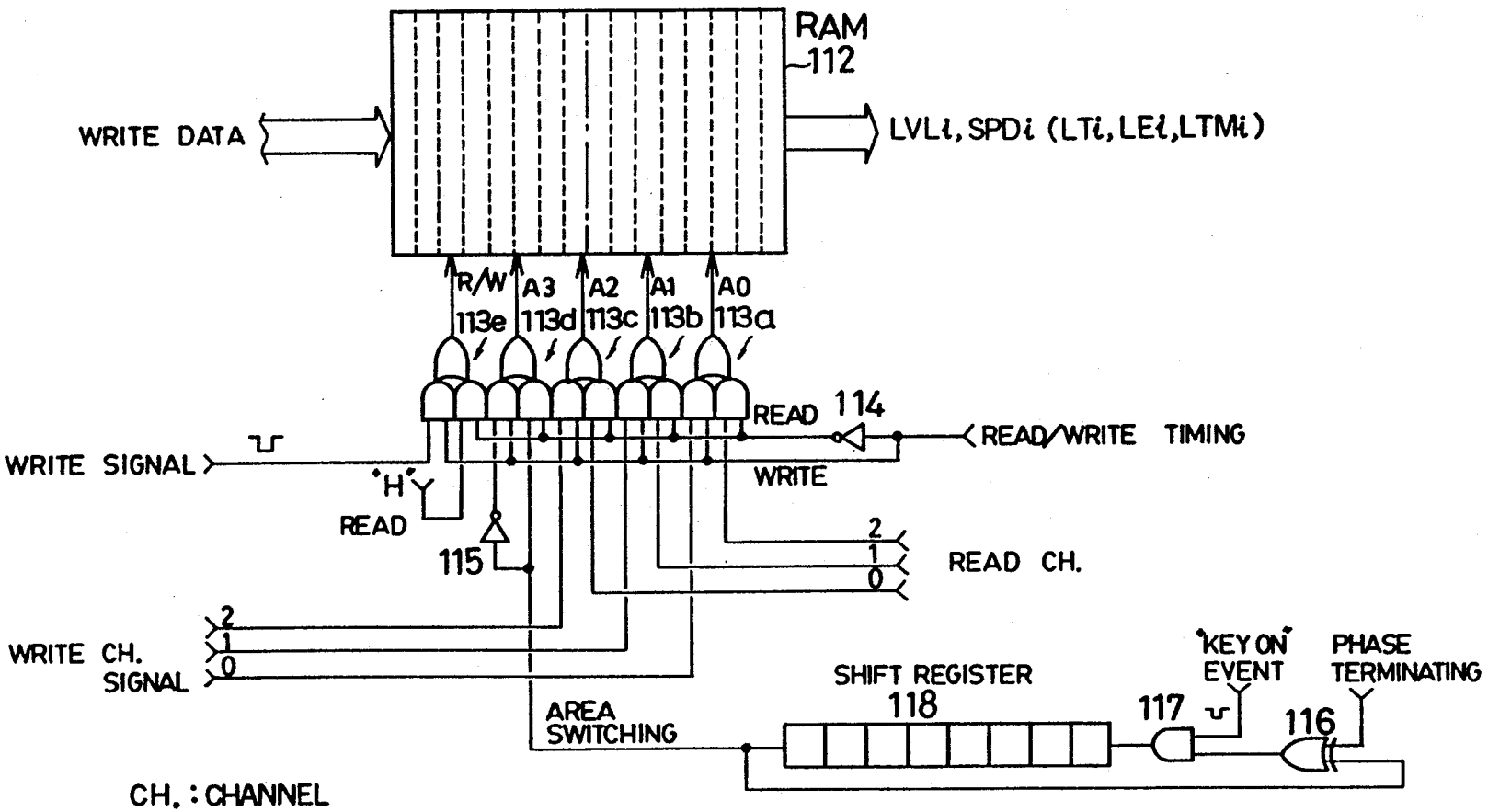
FIGS. 11(A), 11(B), and 12 are diagrams showing multichannel musical sound radiating systems embodying the present invention.
Figure 11:
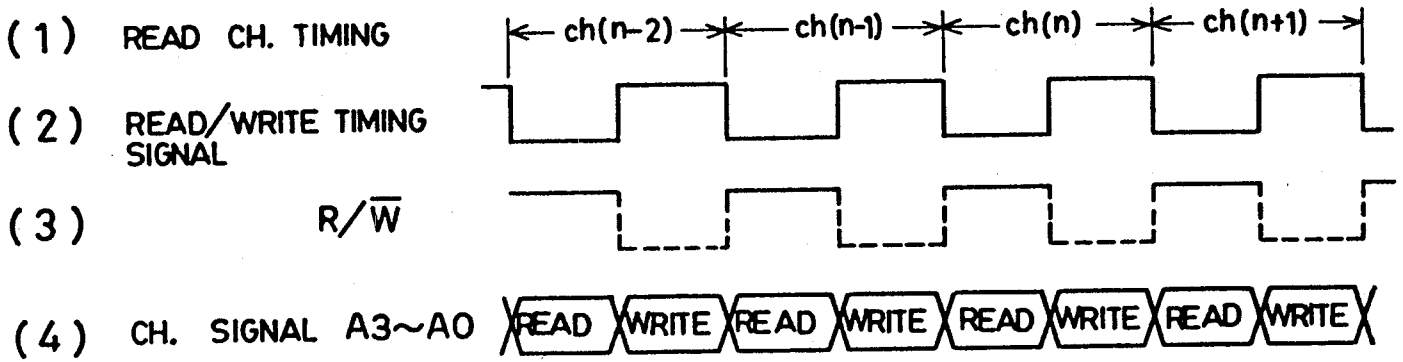

FIGS. 11(A), 11(B) and 12 show an embodiment of the present invention, by which polyphonic musical sounds are generated by performing a time sharing processing.

FIG. 11A shows data latches 61, 62, 107, and 108 of the waveform data reading address generator 28 and the envelope waveform generator 29, which are employed in an 8-channel musical sound generating system. Further, a RAM 112 has 16 storage addresses, grouped into two sets each comprised of 8 storage addresses, and for each of these sets, a group of the level data LVLi and the speed data SPDi or a group of the loop top data LTi, the loop end data LEi, and the loop time data LTMi (each of these data has at most 8 composing elements) are set by the controller 10 and the address controllers 40 and 85. Further, a part of each of the sets of the storage addresses are used for reading data, currently needed to generate musical sounds, from the corresponding storage areas. The residual parts of each set of the storage addresses, however are used for writing data, needed to generate the next musical sounds, to the corresponding storage areas. These two parts of each of the sets of the storage addresses are alternately switched one with the other, and used in the process of generating musical sounds.

Channel signals A0–A2 indicating 8 storage addresses of each set of the RAM 112 are supplied to the RAM 112 through data selectors 113*a*, 113*b* and 113*c*. Further, one of the set of read channel signals and that of the write channel signals is chosen by the data selectors 113*a*, 113*b* and 113*c*. The read channel signals A0–A2 are obtained from data counted by system clock signals used for synchronizing the whole of the electronic musical instrument, and are equivalent to channel timing signals shown in FIG. 11(B) (1), but the write channel signals A0–A2 are supplied from the controller 10. Note, the read channel signals may be used as the write channel signals on condition that the data writing timing is synchronized with the channel timing signal of FIG. 11(B) (1).

The two sets of the RAM 112 are selected and switched from one to the other in accordance with an area switching signal, which is output to a data selector 113*d* without being changed and is further output thereto after inversion by an inverter 115. This area switching signal indicates high order address data A3, the order of which is higher than that of the data indicated by the read and write channel signals A0–A2, and an output of a shift register 118 is used as the area switching signal. The output of this shift register 118 is fed back thereto through an EXCLUSIVE-OR gate 116 and an AND gate 117. Further, the phase terminating signal from the comparator 37 or the loop terminating signal from the loop time discriminating signal 81 are output to the EXCLUSIVE-OR gate 116, and thus upon terminating the phase or the loop, the area switching signal is inverted. The KEY ON event signal, the level of which is low, from the inverter 68 or 104 is input to the AND gate 117, so that the data indicated by the area switching signal is cleared.

As shown in FIG. 11(B) (3), the level of a read signal is high and that of a write signal is low. The write signal, which is output from the controller 10, and the read signal, the level of which is always high, are input to the RAM 112 through a data selector 113*e*.

As shown in FIGS. 11(B) (2) and (4), the data selectors 113*a*–113*e* carry out the selecting and switching operations in accordance with read/write timing signals, which cause a switching of the read and write operations from one to the other within a period of the channel timing signal. These read/write timing signals are input to AND gates provided at the writing portion of the data selectors 113*a*–113*e* as enable signals. Further, these read/write timing signals are inverted by inverter 114, and thereafter, input to AND gates provided at the reading portion of the data selectors 113*a*–113*e* as an enable signals. Note, the data writing tuning as shown in FIG. 11(B) (4) is determined in accordance with the write channel signal output by the controller 10, regardless of the channel timing of FIG. 11(B) (1).

FIG. 12 shows an envelope waveform generator 29A, a waveform data reading address generator 28A, a controller 10A, and address controllers 40A and 85A and so forth provided in the multichannel musical tone generating system. The write request signal and the KEY ON event signal output by the generators 28A and 29A are input to the address controllers 40A and 85A without delay. Further, the write request signal is input to the controller 10A through a request signal discriminating device 123, and the read channel signal of FIG. 11(A) used in the generators 28A and 29A, is input to the controller 10A through a request channel discriminating device 124.

The request signal discriminating device 123 and the request channel discriminating device 124, each of which may be constructed by, for example, an interface circuit, perform the discrimination of signals and data, and the synchronization of the processing and so on. The controller 10A outputs write signals to the address controllers 40A and 85A for the channel indicated by the write request signal, and thus the address data indicating an address of the ROM 13 is incremented by 1. Further, the level data LVLi and the speed data SPDi, which are used in the next phase, or the loop top data LTi, the loop end data LEi, and the loop time data LTMi, which are used in the processing of the next loop, are read from the ROM 13 and input to the RAM 112 of the generators 28A and 29A together with the write signal.

The address data, which indicates addresses of the ROM 13, output by the address controllers 40A and 85A and the controller 10A are switched from one to the other by a selector 122, in a time sharing manner. Further, a clock pulse, the frequency of which is four times that of the channel timing signal, is used as a selection signal for the selector 122, which selects one of the address data input thereto. The read channel signal from the request channel discriminating device 124 is used as the write channel signal by the controller 10A. Note, the read channel signals output by generators 28A and 29A may be output as write channel signals through a group of AND gates, which are enabled by the write request signal, without processing by the discriminating device 124.

Furthermore, the key information such as the phase angle step data PD, the read operation starting address data ST, and the initial value LVLO of the amplitude of the envelope is read from the ROM 13 and is then input to the generators 28A and 29A. Note, the data ST and the value LVLO may be stored in the RAM 14 or in the key information memory (not shown).

To construct the multichannel musical sound generating system, the following requirements must be met. Namely, a feedback input type shift register, the number of stages of which is equal to that of the channels, is used as the phase angle step data memory 71. Alternatively, a readable/writable RAM can be used as the memory 71. Further, the number of each of the counters 43 and 86 of the address controllers 40A and 85A is equal to that of the channels, and furthermore, the count data of the counters 43 and 86 is produced or cleared through a demultiplexer or a selector in response to the write request signal or the KEY ON event signal. Also, the number of each of the reference time changing device 140, the reference time signal generator 141, and the loop counter 142 of the loop time discriminating portion 81 is equal to that of the channels, and further, the time count data of each of the counters 142, . . . is output to the comparator 146.

9. THE REPRODUCTION OF A REPEAT IN THE ENVELOPE WAVEFORM DATA

Figure 13A:
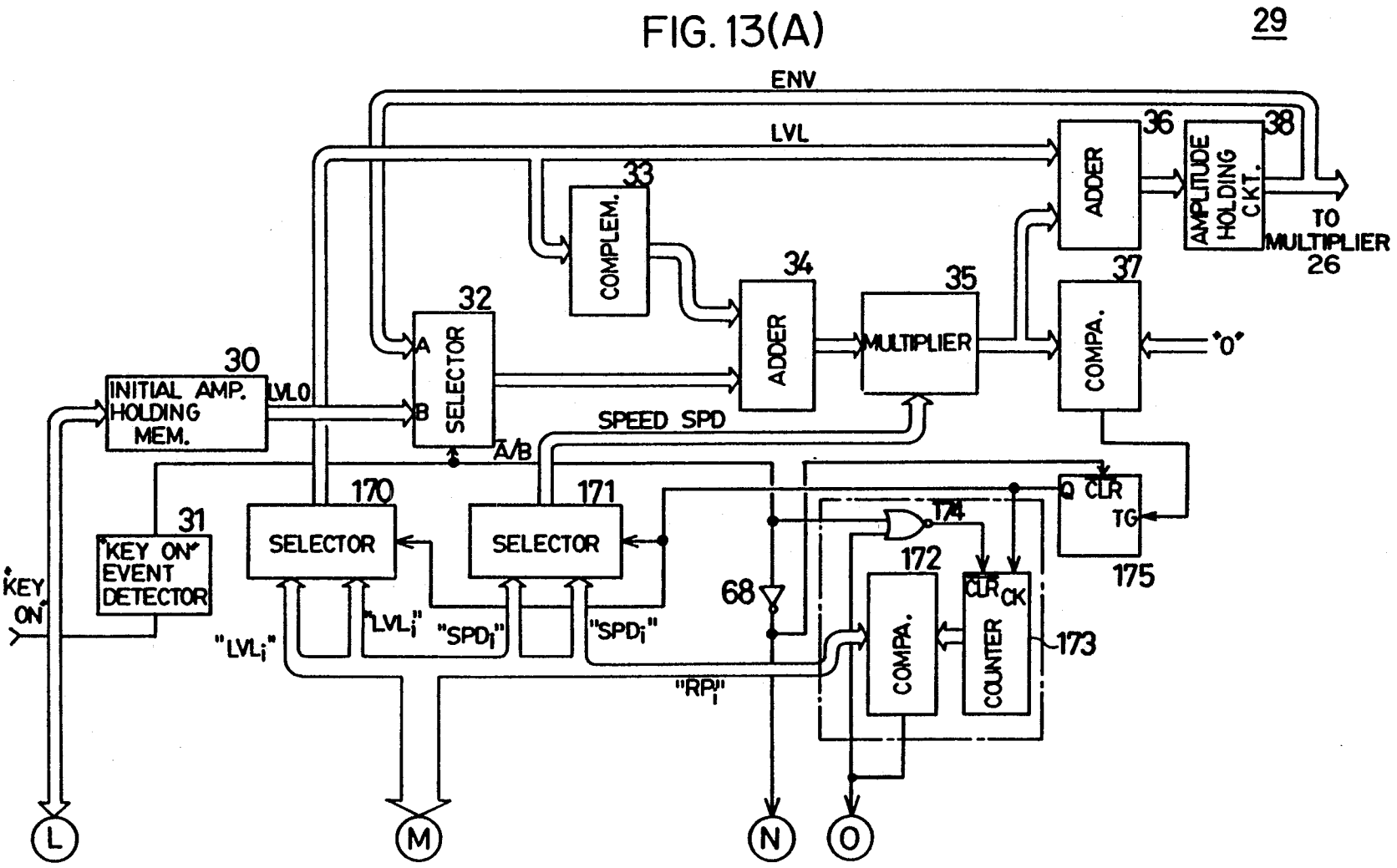
FIGS. 13(A) and 13(B) are circuit diagrams of an embodiment of the present invention, which repeatedly reproduces each phase of the envelope.
Figure 13:
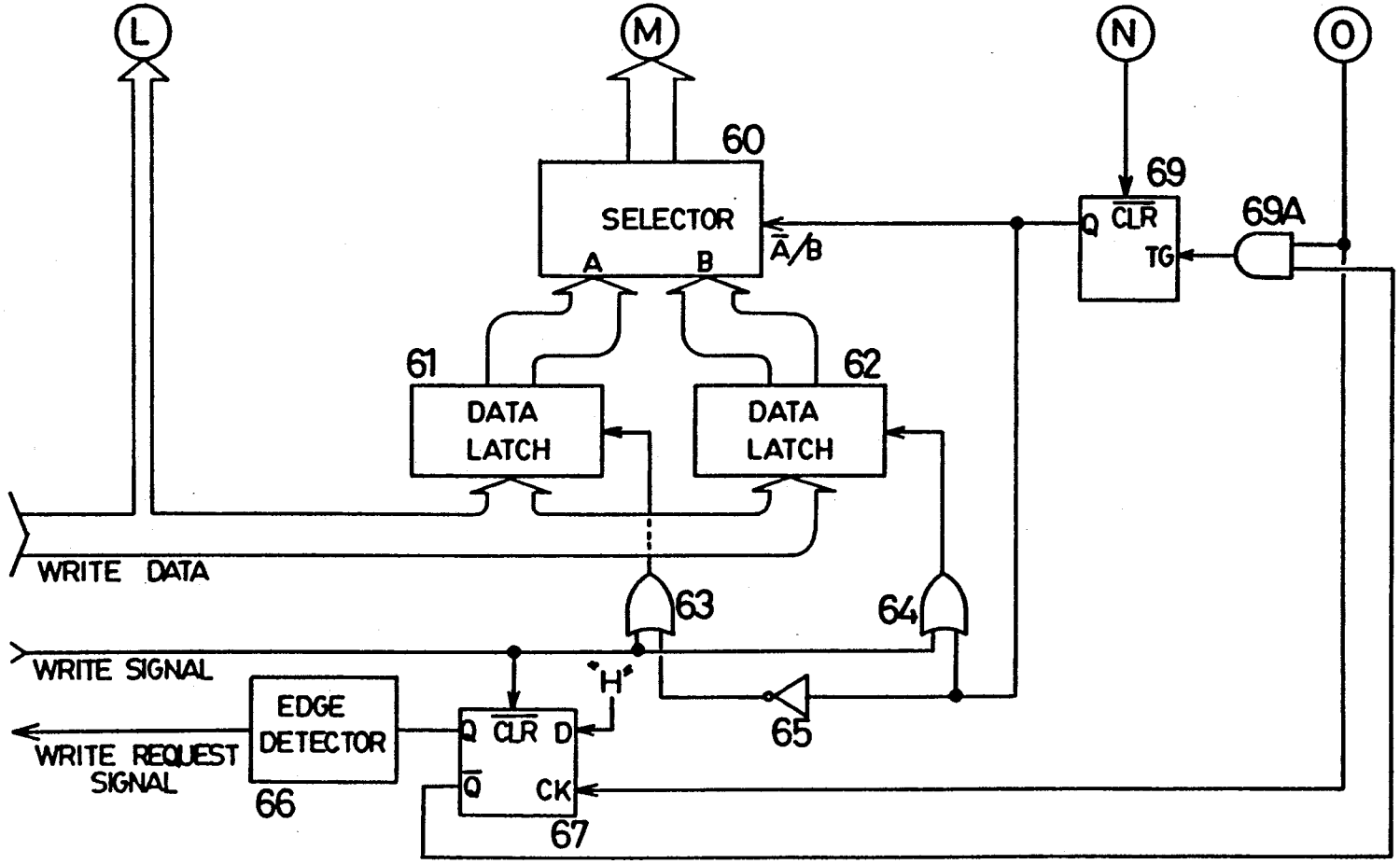
FIG. 13(C) is a diagram showing the waveform of a repeating type envelope.
Figure 13:
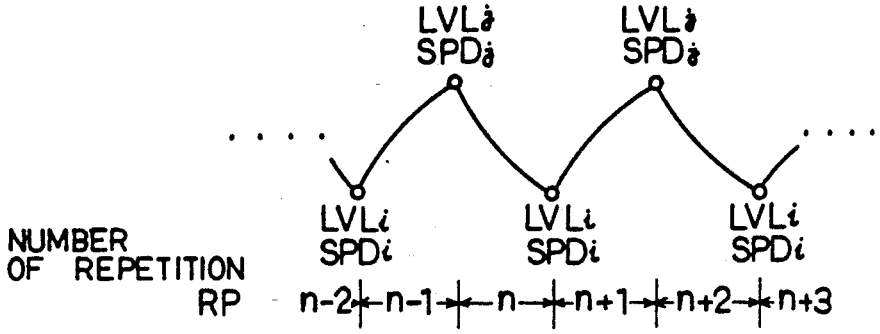

FIGS. 13(A) and 13(B) show another example of the envelope waveform generator 29 of the present invention. As shown in FIG. 13(C), in this envelope waveform generator, the processing of a phase using the level data LVLi and the speed data SPDi and that of another phase using level data LVLj and speed data SPDj are alternately repeated. Note, the repetition number data RPi denotes the number of repetitions.

The level data LVLi and LVLj, the speed data SPDi and SPDj, and the repetition number data RPi are read by the controller 10 or the address controller 85 from the ROM 13 and the readout data is then latched by one of the data latches 61 and 62. Among the level data LVLi and LVLj, the speed data SPDi and SPDj, and the repetition number data RPi output by the data latch 61 or 62, one of the level data LVLi and LVLj is selected by the selectors 60 and 170 and the selected level data is fed to the adder 36. Similarly, one of the speed data SPDi and SPDj is selected by the selectors 60 and 171 and the selected level data is fed to the multiplier 35. The repetition number data RPi is output to a comparator 172 through the selector 60.

When a phase of the envelope is terminated and the comparator 37 outputs a coincidence signal, this coincidence signal is input to a flip-flop 175, whereby the output Q of the flip-flop 175 is inverted. This flip-flop 175 is the same as the flip-flops 69 and 105, and is cleared in response to the KEY ON event signal. The output Q of this flip-flop 175 is supplied to the selectors 170 and 171 as a selection switching signal, and thus at the termination of each phase, the set of data selected by the selectors 170 and 171 is switched between the set of the data LVLi and the data SPDi and that of the data LVLj and the data SPDj.

Further, the output Q of the flip-flop 175 is input to a repetition counter 173, whereupon the number of the repetitions in the current phase is counted. The count data representing the count by the counter 173 is input to the comparator 172, to which the data RPi is also input. If the count data coincides with the data RPi, a coincidence signal is input to the counter 173 through a NOR gate 174, as a clearing signal. This coincidence signal is also input to the flip-flop 69 through an AND gate 69A, whereby the output Q of the flip-flop 69 is inverted. Accordingly, the content of the selection of the selector 60 is switched between the output of the data latch 61 and that of the data latch 62. Then the electronic musical instrument begins to generate the envelope of the next section or phase to be repeated. Further, the counter 173 is cleared in response to the KEY ON event. The remaining processes are the same as those of the envelope waveform generator 29 of FIG. 2(A) and (B).

Therefore, in the parameter signal generating device, the level data LVLi and LVLj, the speed data SPDi and SPDj, and the repetition number data RPi can be stored in the ROM 13 instead of in the tone generators 15, 16, . . . , and thus, in accordance with the present invention, the cost of the envelope waveform generator 29 can be lowered. Also, a large-scale integration of the tone generators 15, 16, . . . , each including the envelope waveform generator 28, can be facilitated.

Moreover, it is easy to change the data RPi as repetition time data RPTi, as shown in FIGS. 1(A), 1(B) and 10 and furthermore, the data RPTi may be changed in accordance with the timbre, the compass, and various parameters.

Further, in this case, in the envelope wave form generator 29 of FIG. 13(A) and 13(B), a portion including the comparator 172 and the counter 173, indicated by a one-dot chain line in this Figure, may be replaced with a corresponding portion of FIG. 10, and the phase terminating signal can be input to the AND gate 144 instead of the loop end attainment signal. Further, a signal from the KEY ON event detector 31 may be used as the KEY ON event signal, the loop terminating signal may be output as the repetition terminating signal, and the data RPi may be replaced with the data RPTi and the output Q of the flip-flop 175 may be output only to the selectors 170 and 171.

Consequently, even when repeatedly generating the envelope waveform, the repeated generation of the envelope may be performed within a constant time.

10. OTHER EXAMPLES OF THE REPRODUCTION OF A LOOP IN THE WAVEFORM DATA

Figure 14A:
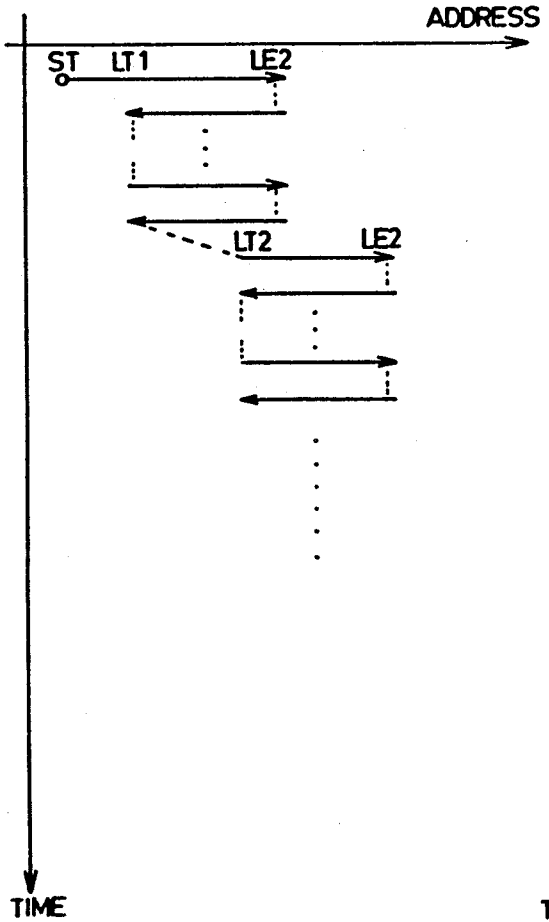
FIGS. 14(A), 14(B) and 14(C) are diagrams illustrating other examples of the reproduction of the loop by the waveform data reading address generator 28.
Figure 14B:
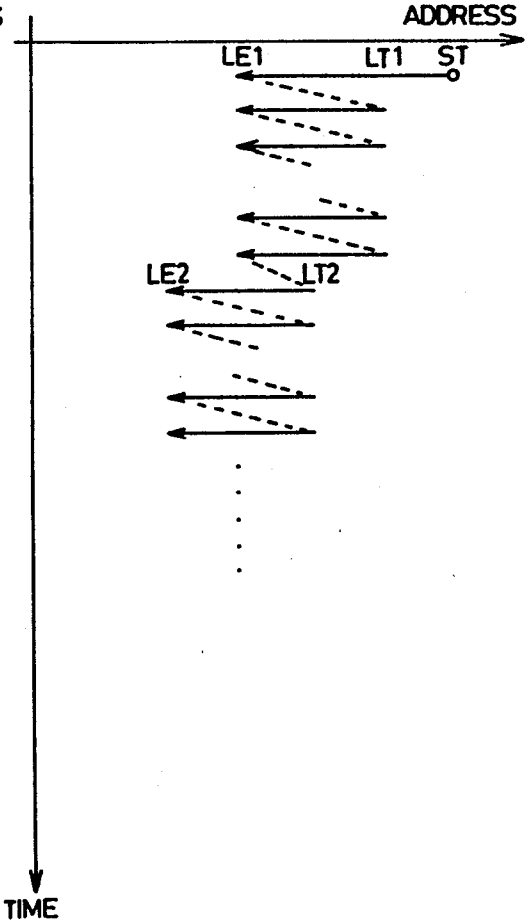
Figure 14C:
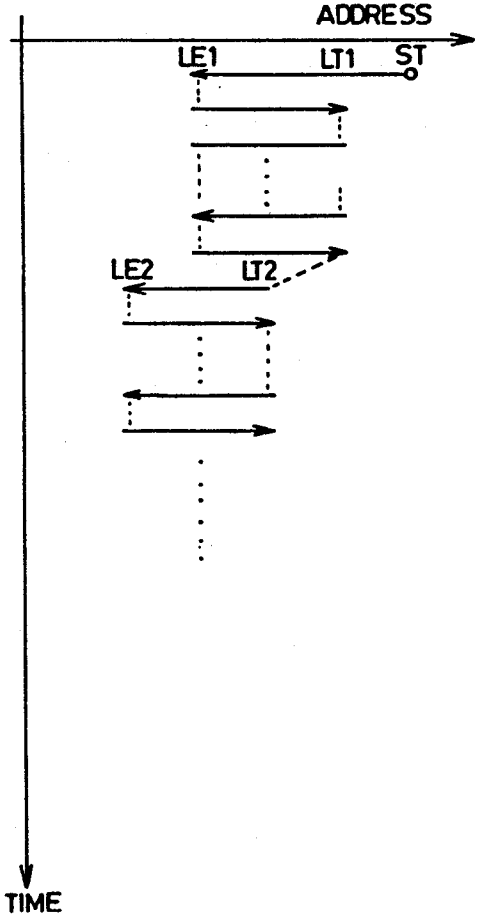
Figure 15:
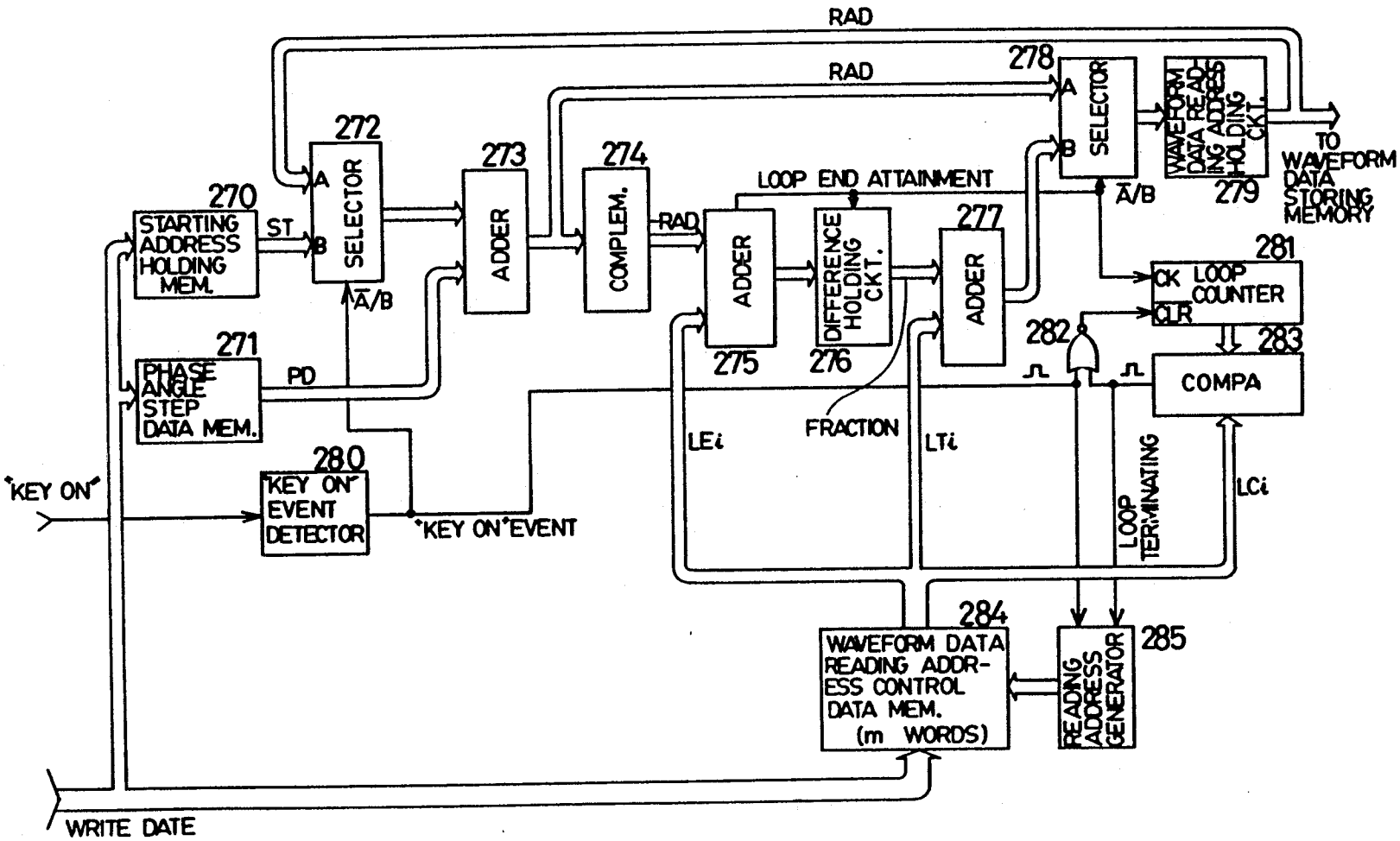
FIG. 15 is a circuit diagram of a conventional waveform data reading address generator.
Figure 16:
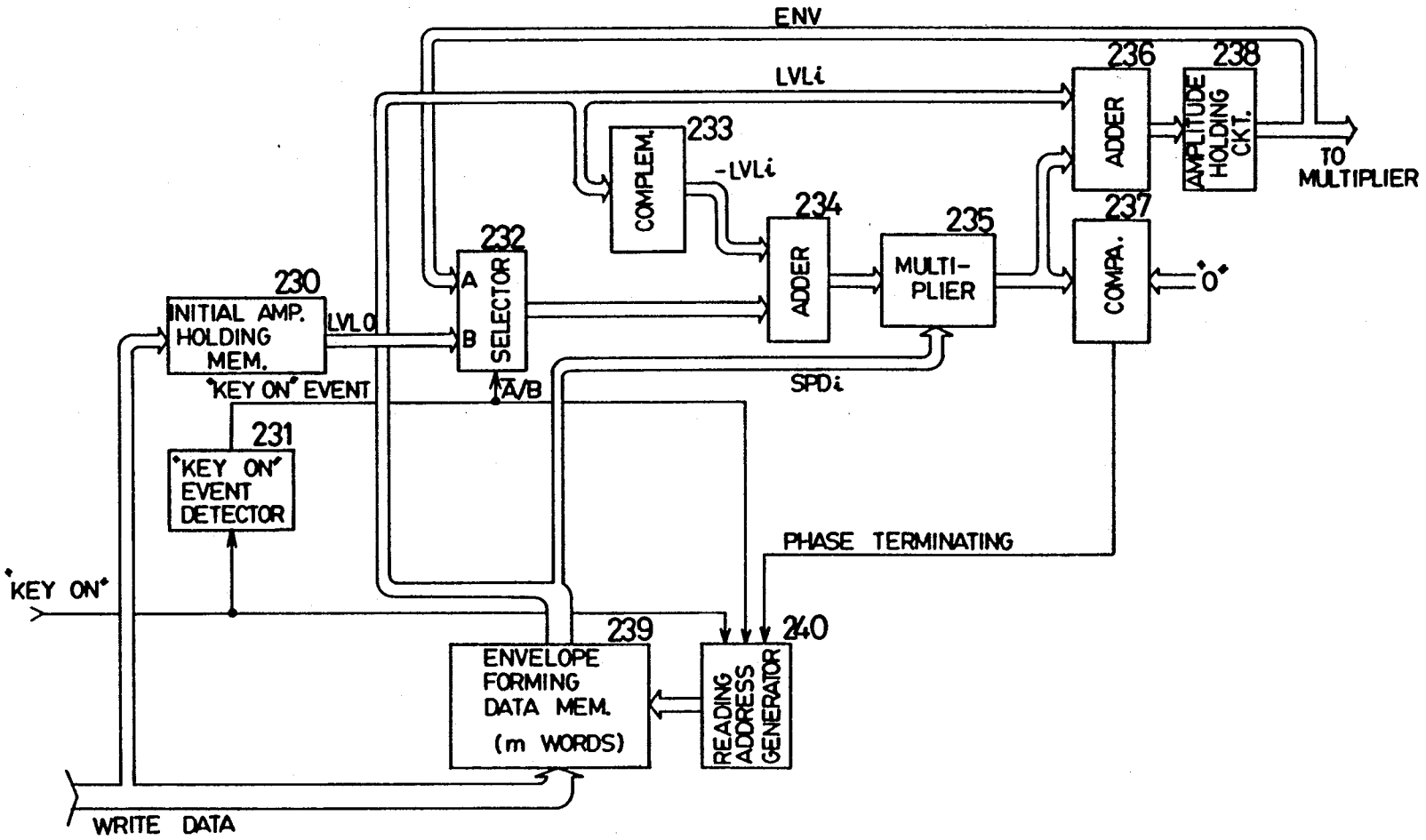
FIG. 16 is a circuit diagram of a conventional envelope waveform generator; and, FIGS. 17(1) and 17(2) are diagrams illustrating the conventional process of reproducing the loop.
Figure 17:
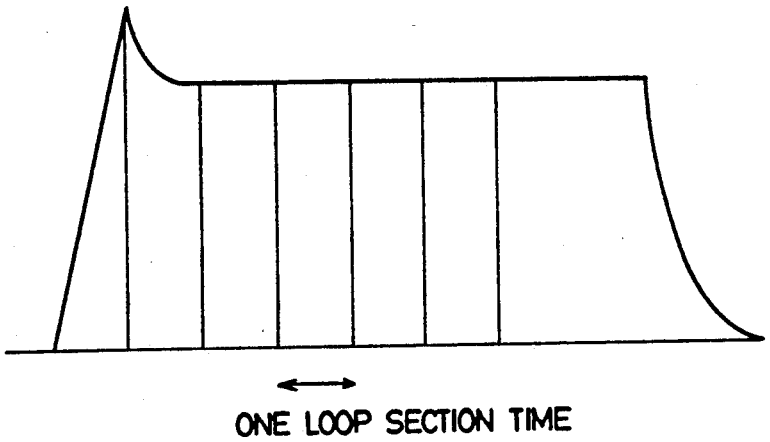
Figure 17:
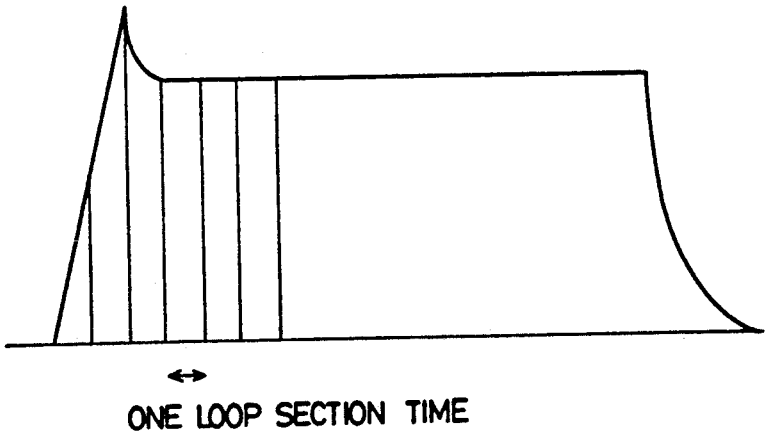

FIGS. 14(A)–14(C) are diagrams illustrating other examples of the reproduction of a loop in the waveform data reading address generator 28.

FIG. 14(A) is a diagram for illustrating an example of the reproduction of a loop in which the loop is repeatedly read in both the forward and backward directions (i.e., in both the ascending and descending order). In this case, data to be supplied to the adders 75 and 77 may the switched from one to be other by using two selectors every time the loop end attainment signal is output from the adder 75. Namely, the loop end attainment signal is input to a flip-flop which is the same as the flip-flop 105, and the output Q thereof is used as the selection signals for the two selectors. Further, both the loop top data LTi and the loop end data LEi are input to the two selectors, and moreover, the selection signal is input to one of these selectors without change, and a signal obtained by inverting the selection signal by an inverter is fed to the other selector, and the data selected from each selector is then output to the adders 75 and 77. Further, the phase angle step data PD from the memory 71 is output to the adder 73 through a group of EXCLUSIVE-OR gates, the selection signal is then input to each gate of the group of EXCLUSIVE-OR gates, and further, the selection signal is input to the Cin-terminal of the adder 73.

FIG. 14(B) is a diagram illustrating an example of the reproduction of a loop in which the data of the loop is repeatedly read in only the backward direction (i.e., in the descending order). In this case, the value indicated by the loop top data LTi is made larger than that indicated by the loop end data LEi, and the value indicated by the read operation starting address data ST is made larger than that indicated by the loop top data LT1. Further, the phase angle step data PD from the memory 71 is inverted by a group of inverters, and a signal having a high level is input to the Cin-terminal of the adder 73.

FIG. 14(C) is a diagram illustrating an example of the reproduction of a loop in which the data of the loop is read in the backward direction, and thereafter, the data of the loop first is repeatedly read in both the forward and backward directions (i.e., in both the ascending and descending order). In this case, the configuration of the circuit is exactly the same as that of the circuit of FIG. 14(A). Further, the value indicated by the loop top data LTi is made larger than that indicated by the loop end data LEi, and the value indicated by the read operation starting address data ST is made larger than that indicated by the loop top data LT1.

Therefore, in a such reproduction of a loop, the time taken to reproduce each loop becomes constant regardless of the pitch, and further, loop sections during the radiation of a musical sound can be well-balanced, and thus, an inclusion in the musical sound radiated by the electronic musical instrument of an unnecessary changing factor, in response to the change of the pitch thereof, it can be prevented.

Although preferred embodiments of the present invention have been described above, it is understood that the present invention is not limited thereto and that other modifications will be apparent to those skilled in the art without departing from the spirit of the invention.

For example, in the foregoing description, the level data LVLi, the speed data SPDi, and the repetition number data RPi, or, the loop top data LTi, the loop end data LEi and the loop time data LTMi (the loop count data LCi) are described as one-word data, but each of these data may be represented by a plurality of words corresponding to the number of bits used for system data. Further, if a general-use memory is employed, this data may be stored in the RAM 14, the key information memory 20, an assignment storing memory 121, memories included in the controllers 10 and 10A, and a memory connected to an external circuit other than the ROM 13. Moreover, as long as the time taken to reproduce each loop can be kept at a constant value regardless of the pitch, the data to be input to the reference time changing device of the loop time discriminating portion 81 may be data representing timbres or musical effects and data on the strength and speed of a sound radiating operation, such as "after touch" data and "initial touch" data.

The scope of the present invention, therefore, is determined solely by the appended claims.

I claim:

1. A waveform signal generator comprising:

waveform signal generating means for generating a waveform signal;

waveform signal generation repeating means for directing said waveform signal generating means to repeat the generation of the waveform signal for a given number of repetitions, represented by a repetition value;

repetition time measuring means for measuring the length of time taken to repeat the generation of the waveform signal, and preventing a changing factor in generating the waveform signal by said waveform signal generating means and directing repetition of the generation of the waveform signal by said waveform signal generation repeating means;

time data storing means for storing a time data representing a time to repeat the generation of the waveform signal by said waveform signal generation repeating means;

time data reading means for reading the time data from said time data storing means;

comparing means for comparing the time measured by said repetition time measuring means and the time data read by time data reading means; and repetition control means for terminating the repetition of the generation of the waveform signal in accordance with the result of the comparison performed by said comparing means.

2. The waveform signal generator as set forth in claim 1, wherein said repetition control means directs said waveform signal generation repeating means to proceed to the next repetitive generation of the waveform signal.

3. The waveform signal generator of claim 1, wherein the time data compared by said comparing means changes in accordance with a timbre of the musical sound to be radiated.

4. The waveform signal generator of claim 1, wherein the time data compared by said comparing means changes in accordance with musical effects performed on the musical sound to be radiated.

5. The waveform signal generator of claim 1, wherein the time data compared by said comparing means changes in accordance with a strength of a musical sound radiating operation.

6. The waveform signal generator of claim 1, wherein the time data compared by said comparing means changes in accordance with a speed of a musical sound radiating operation.

7. The waveform signal generator as set forth in claim 1, wherein said waveform signal generating means generates a musical tone waveform signal.

8. The waveform signal generator as set forth in claim 1, wherein said waveform signal generating means generates an envelope waveform

9. The waveform signal generator as set forth in claim 1, wherein said waveform signal generating means generates a modulation waveform signal.

10. The waveform signal generator as set forth in claim 1, wherein said waveform signal generating means generates a plurality of waveform signals in a timesharing manner.

11. The waveform signal generator of claim 1, wherein waveform signal generation repeating means includes parameter generating information storing means and parameter generating information reading means, and said parameter generating information storing means is provided separate from said waveform signal generating means.

12. A waveform signal generator comprising:

envelope waveform signal generating means for generating an envelope waveform signal;

repeating means for directing said envelope waveform signal generating means to repeat the generation of the envelope waveform signal;

repetition number measuring means for measuring the number of times the generation of the envelope waveform signal is repeated;

number data storing means for storing number data representing a number of times for repeating the generation of the envelope waveform signal, by said repeating means;

number data reading means for reading the number data from said number data storing means;

comparing means for comparing the number of times measured by said repetition number measuring means and the number data read by said number data reading means; and repetition control means for terminating the repetition of the generation of the envelope waveform signal in accordance with the result of the comparison performed by said comparing means.

13. A waveform signal generator comprising:

input means including a plurality of keys;

general use memory means for storing musical tone waveform data, including loop top data, loop end data, loop count data, and loop time data, and envelope data, including level data and speed data;

controller means for detecting activation of the plurality of keys, said controller means including waveform address controlling means for retrieving musical tone waveform data located at addresses corresponding to the activated keys and envelope address controlling means for retrieving envelope data corresponding to the activated keys;

waveform data reading address generating means, including at least one waveform data latch means for alternately reading data samples of the loop top data, loop end data, loop count data, and loop time data directly from said general use memory means, and waveform selecting means for alternately selecting an output of each of the at least one waveform data latch means to produce a waveform data signal;

envelope waveform generating means, including at least one envelope data latch means for alternately reading data samples of the level data and the speed data directly from said general use memory means, and envelope selecting means for alternately selecting an output of each of the at least one envelope data latch means to produce an envelope signal; and sound radiating means for repetitively radiating a musical tone based on the waveform data signal and the envelope signal;

wherein said general use memory means eliminates a need for local memories for said waveform data reading address generating means and said envelope waveform generating means.

14. A waveform signal generator comprising:

input means including a plurality of keys;

general use memory means for storing musical tone waveform data, including loop top data, loop end data, loop count data, and loop time data, and envelope data, including level data and speed data;

controller means for detecting activation of the plurality of keys, said controller means including waveform address controlling means for retrieving musical tone waveform data located at addresses corresponding to the activated keys and envelope address controlling means for retrieving envelope data corresponding to the activated keys;

waveform data reading address generating means, including at least one waveform data latch means for alternately reading data samples of the loop top data, loop end data, loop count data, and loop time data directly from said general use memory means, waveform selecting means for alternately selecting an output of each of the at least one waveform data latch means to produce a waveform data signal and loop time discriminating means for determining a time interval for reproducing the waveform data signal;

envelope waveform generating means including at least one envelope data latch means for alternately reading data samples of the level data and the speed data directly from said general use memory means, and envelope selecting means for alternately selecting an output of each of the at least one envelope data latch means to produce an envelope signal; and sound radiating means for repetitively radiating a musical tone based on the waveform data signal envelope signal;

wherein the time interval for each repetition is held constant by said loop time discriminating means, regardless of a pitch of the musical tone.

15. The waveform signal generator of claim 14, wherein a rate of change of the envelope signal corresponds to a rate of change of the speed data.

16. The waveform signal generator of claim 14, wherein a difference between successive samples of the envelope signal is equal to a corresponding sample of the level data and as a value of a data sample of a envelope signal approaches the value of the corresponding sample of the level data, the difference between successive samples of the envelope signal decreases.

17. The waveform signal generator of claim 14, wherein said loop time discriminating means compares the time interval of a previous repetition to a predetermined value in order to determine the time interval of a subsequent repetition.

18. The waveform signal generator of claim 16, wherein the predetermined value is a function of a timbre of the musical tone.

19. The waveform signal generator of claim 16, wherein the predetermined value is a function of musical effects of the musical tone.

20. The waveform signal generator of claim 16, wherein the predetermined value is a function of a key speed of the musical tone.

* * * * *